US010775710B1

(12) United States Patent
Kamae et al.

(10) Patent No.: US 10,775,710 B1
(45) Date of Patent: Sep. 15, 2020

(54) TONER

(71) Applicant: CANON KABUSHIKI KAISHA, Tokyo (JP)

(72) Inventors: Kentaro Kamae, Kashiwa (JP); Ryuji Murayama, Nagareyama (JP); Junichi Tamura, Toride (JP); Masaharu Miura, Toride (JP); Hayato Ida, Toride (JP); Takaho Shibata, Tokyo (JP); Koh Ishigami, Abiko (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/534,343

(22) Filed: Aug. 7, 2019

(30) Foreign Application Priority Data

Apr. 22, 2019 (JP) ..... 2019-081290
Jul. 10, 2019 (JP) ..... 2019-128589

(51) Int. Cl.
*G03G 9/08* (2006.01)
*G03G 9/097* (2006.01)

(52) U.S. Cl.
CPC ..... *G03G 9/09725* (2013.01); *G03G 9/0819* (2013.01)

(58) Field of Classification Search
CPC . G03G 9/09725; G03G 9/0819; G03G 9/0825
See application file for complete search history.

(56) References Cited

U.S. PATENT DOCUMENTS 4,555,467 A * 11/1985 Hasegawa ..... G03G 9/09708 430/108.6
5,565,295 A * 10/1996 Tavernier ..... G03G 9/0819 430/108.1
7,279,262 B2 10/2007 Fujikawa et al.
7,288,348 B2 10/2007 Hayami et al.
7,396,626 B2 7/2008 Fujikawa et al.
7,396,629 B2 7/2008 Baba et al.
7,611,813 B2 11/2009 Ida et al.
7,629,100 B2 12/2009 Okamoto et al.
7,833,687 B2 11/2010 Kato et al.
7,858,283 B2 12/2010 Ishigami et al.
7,906,262 B2 3/2011 Ishigami et al.
7,927,775 B2 4/2011 Komatsu et al.
7,939,233 B2 5/2011 Inoue et al.
8,084,174 B2 12/2011 Hasegawa et al.
8,129,085 B2 * 3/2012 Yamamoto ..... G03G 9/081 430/110.3
8,137,886 B2 3/2012 Baba et al.
8,298,742 B2 10/2012 Okamoto et al.
8,323,726 B2 12/2012 Naka et al.
8,697,327 B2 4/2014 Shibata et al.
8,921,023 B2 12/2014 Baba et al.
8,927,188 B2 1/2015 Naka et al.
8,945,805 B2 2/2015 Baba et al.
8,974,994 B2 3/2015 Kamae et al.
8,986,914 B2 3/2015 Fujikawa et al.
9,034,551 B2 5/2015 Endo et al.
9,057,970 B2 6/2015 Ida et al.
9,058,924 B2 6/2015 Komatsu et al.
9,063,443 B2 6/2015 Ishigami et al.
9,075,328 B2 7/2015 Minagawa et al.
9,348,247 B2 5/2016 Ida et al.
9,372,420 B2 6/2016 Mizo et al.
9,540,483 B2 1/2017 Ida et al.
9,665,021 B2 5/2017 Ohtsu et al.
9,665,023 B2 5/2017 Kamae et al.
9,671,707 B2 6/2017 Minagawa et al.
9,696,644 B2 7/2017 Ida et al.
9,897,934 B2 2/2018 Tamura et al.
9,915,885 B2 3/2018 Katsumata et al.
9,969,834 B2 5/2018 Ohtsu et al.
10,012,918 B2 7/2018 Ishigami et al.
10,012,920 B2 7/2018 Shibata et al.
10,012,921 B2 7/2018 Kamae et al.
10,078,281 B2 9/2018 Ida et al.
10,088,765 B2 10/2018 Miyakai et al.
10,133,201 B2 11/2018 Kamae et al.
10,175,595 B2 1/2019 Onozaki et al.
10,197,936 B2 2/2019 Onozaki et al.
10,203,619 B2 2/2019 Yamashita et al.
10,216,108 B2 2/2019 Iwasaki et al.
10,228,629 B2 3/2019 Tamura et al.
10,234,777 B2 3/2019 Ohtsu et al.
10,353,312 B2 7/2019 Kamae et al.
10,423,090 B2 9/2019 Ohtsu et al.
10,451,990 B2 10/2019 Kamae et al.
2009/0258308 A1* 10/2009 Park ..... G03G 9/0804 430/108.1
2010/0028796 A1 2/2010 Nakamura et al.
2010/0183971 A1 7/2010 Fujikawa et al.
2012/0214097 A1 8/2012 Naka et al.
2013/0108955 A1 5/2013 Shibata et al.
2013/0115548 A1* 5/2013 Yang ..... G03G 9/0806 430/105

(Continued)

FOREIGN PATENT DOCUMENTS

JP 2006-145800 A 6/2006
JP 2012-203096 A 10/2012
JP 2013-088686 A 5/2013

OTHER PUBLICATIONS

English language machine translation of JP 2006-145800. (Year: 2006).*

(Continued)

*Primary Examiner* — Christopher D Rodee
(74) *Attorney, Agent, or Firm* — Venable LLP

(57) ABSTRACT

A toner includes a toner particle containing a binder resin and a silica fine particle A on a surface of the toner particle, wherein D50 on a number basis of the toner is 3.0 to 6.0 the silica fine particle A is a particle having a particle diameter of 80 to 500 nm, the particle diameter being confirmable by observing the toner with a SEM, and when the average coverage with the silica fine particle A determined by image analysis of a particle group of a small particle diameter side of the toner with a SEM is set to $S_s$ and the average coverage with the silica fine particle A determined by image analysis of a particle group of a large particle diameter side of the toner with a scanning electron microscope is set to $S_1$, $S_s$ is 20 to 70 area %, $S_s$ and $S_1$ satisfy $S_1/S_s \leq 0.80$.

5 Claims, 1 Drawing Sheet

(56) References Cited

U.S. PATENT DOCUMENTS

| | | | | |
|---|---|---|---|---|
| 2013/0244159 | A1 | 9/2013 | Ishigami et al. | |
| 2014/0134535 | A1 | 5/2014 | Baba et al. | |
| 2014/0137428 | A1 | 5/2014 | Takenaka et al. | |
| 2014/0141370 | A1* | 5/2014 | Sasaki | G03G 9/09725 430/111.4 |
| 2015/0099227 | A1 | 4/2015 | Ida et al. | |
| 2016/0026104 | A1* | 1/2016 | Fujita | G03G 9/09733 430/108.6 |
| 2016/0085165 | A1* | 3/2016 | Kamiwaki | G03G 9/0825 430/105 |
| 2017/0115584 | A1* | 4/2017 | Nakatani | G03G 9/09708 |
| 2017/0176880 | A1* | 6/2017 | Kanno | G03G 9/08755 |
| 2018/0275540 | A1 | 9/2018 | Matsuo et al. | |
| 2019/0107793 | A1 | 4/2019 | Tamura et al. | |
| 2019/0339629 | A1 | 11/2019 | Yamashita et al. | |

OTHER PUBLICATIONS

U.S. Appl. No. 16/438,537, Kentaro Kamae, filed Jun. 12, 2019.
U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/532,887, Ryuji Murayama, filed Aug. 6, 2019.
U.S. Appl. No. 16/539,245, Ryuji Murayama, filed Aug. 13, 2019.

* cited by examiner

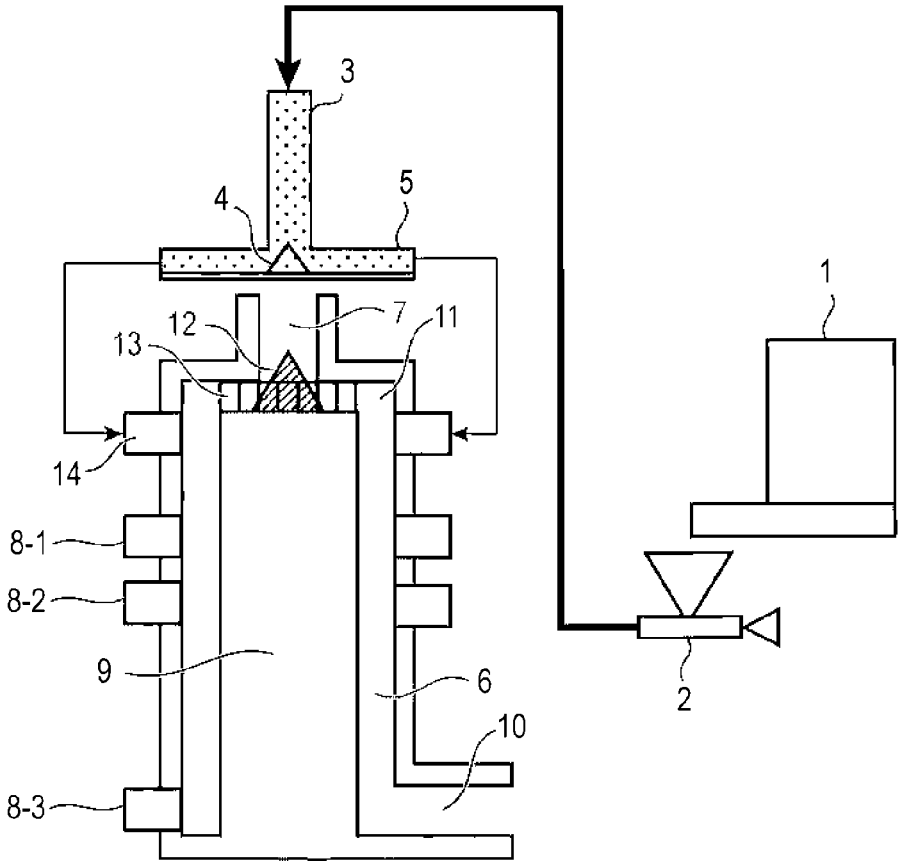
3
4
5
1
12
7
11
13
14
8-1
8-2
9
6
2
10
8-3

TONER

BACKGROUND OF THE INVENTION

Field of the Invention

The present disclosure relates to a toner used for an electrophotographic system, an electrostatic recording system, an electrostatic printing system and the like.

Description of the Related Art

In recent years, as electrophotographic full-color copiers have become popular, not only improvements in speed and image quality but also improvements in additional performance such as energy saving performance, for example, reduction of maintenance costs, have been required.

As a specific measure for improvement in image quality, a toner with a small particle diameter has been required in order to improve dot reproducibility. In view of the above, Japanese Patent Application Laid-Open No. 2013-088686 proposes a toner having a small particle diameter and a sharp particle size distribution in order to improve the dot reproducibility. Further, Japanese Patent Application Laid-Open No. 2006-145800 proposes a toner obtained by, with respect to a toner with variation in particle size distribution, adjusting the coverage with a silicate fine particle in each particle diameter range in order to improve the charging performance and the yield.

As a specific measure for energy saving, a toner that may be fixed at a lower fixing temperature has been required in order to reduce power consumption in the fixing step. In view of the above, Japanese Patent Application Laid-Open No. 2012-203096 proposes a toner in which the amount of an inorganic fine particle, which is fixing inhibiting factor, to be added is defined in order to achieve low-temperature fixing.

SUMMARY OF THE INVENTION

Japanese Patent Application Laid-Open No. 2013-088686 describes a toner with which good image quality in image output under normal temperature and normal humidity environment can be obtained. However, since the toner has constant coverage with a shell layer and inorganic fine particle independent on the particle diameter, the surface charge density is constant such that the amount charged per toner particle is small from the viewpoint of the surface area. This phenomenon more prominently appears on the toner of the fine powder side under high temperature and high humidity environment, and due to the small amount of the toner on the fine powder charged, the electric field dependency becomes small. As a result, the developability of the toner from the developer carrier to the electrostatic latent image carrier decreases such that the image density may decrease. Further, since the force by the pullback bias from the electrostatic latent image carrier is weak in the AC development system, the toner remains adhering to the electrostatic latent image carrier and thus fogging may occur. Furthermore, when long-term image output is performed, an inorganic fine particle externally added to the toner is embedded inside the toner, increasing the non-electrostatic adhesion of the toner, and thus fogging may occur. Further, when long-term image output is performed, separation of the inorganic fine particle externally added to the toner also occurs, increasing the non-electrostatic adhesion of the toner, and thus good developing may be difficult.

A toner described in Japanese Patent Application Laid-Open No. 2006-145800 is a toner in which the coverage with the inorganic fine particle is adjusted for each particle diameter range such that the surface charge density thereof differs depending on the particle diameter. However, since the coverage is adjusted in the direction of suppressing the charging performance of the toner of the fine powder side, a decrease in the image density or occurrence of fogging may occur due to the decrease in developability.

Japanese Patent Application Laid-Open No. 2012-203096 describes a toner having improved low-temperature fixability. However, when the amount of the inorganic fine particle added is applied to the toner having a small diameter from the viewpoint of high image quality, the coverage is lowered from the viewpoint of the surface area and the non-electrostatic adhesion thus becomes high. As a result, the developability of the toner from the developer carrier to the electrostatic latent image carrier decreases such that the image density may decrease. Further, since the adhesion of the toner adhering to the electrostatic latent image carrier increases and becomes greater than the force by the pullback bias from the electrostatic latent image carrier in the AC development system, the toner remains adhering to the electrostatic latent image carrier and thus fogging may occur. On the other hand, when the amount of the inorganic fine particle added is increased in order to reduce the non-electrostatic adhesion, the low-temperature fixability may be lowered.

The present disclosure provides a toner including a toner particle containing a binder resin and a silica fine particle A on a surface of the toner particle, in which the median diameter (D50) on a number basis of the toner is 3.0 μm or more and 6.0 μm or less, the silica fine particle A is a particle having a particle diameter of 80 nm or more and 500 nm or less, the particle diameter being confirmable by observing the toner with a scanning electron microscope, and when the average coverage with the silica fine particle A determined by image analysis of a particle group on a small particle diameter side having particle diameter being D50 or less of the toner with a scanning electron microscope is set to $S_s$ and the average coverage with the silica fine particle A determined by image analysis of a particle group on a large particle diameter side having particle diameter being more than D50 of the toner with a scanning electron microscope is set to $S_1$, the average coverage $S_s$ is 20 area % or more and 70 area % or less, and the average coverages $S_1$ and $S_s$ satisfy the following Expression (1).

$$S_1/S_s \leq 0.80 \quad (1)$$

The toner of the present disclosure exhibits excellent image quality without variation of the non-electrostatic adhesion of the toner even in long-term image output and has excellent low-temperature fixability and developability as well as excellent member contamination suppression effect.

Further features of the present disclosure will become apparent from the following description of exemplary embodiments with reference to the attached drawing.

BRIEF DESCRIPTION OF THE DRAWINGS

FIGURE is a view of a surface treatment apparatus used in the present disclosure.

DESCRIPTION OF THE EMBODIMENTS

Preferred embodiments of the present disclosure will now be described in detail in accordance with the accompanying drawing.

In the present disclosure, the expression "A or more and B or less" or "A to B" representing a numerical range indicates a numerical range including the lower limit and the upper limit which are endpoints, unless otherwise specified.

The inventors of the present disclosure have studied toners with which both low-temperature fixability and developability are achieved. In the study, the present inventors finely classified forces acting on the toner in the electric field between the developer carrier and the electrostatic latent image carrier. As a result, it has been found that a decrease in the toner particle diameter inevitably results in a decrease in the developability because the non-electrostatic adhesion to the electrostatic latent image carrier is proportional to the particle diameter whereas the amount of the toner charged affecting the electric field dependency is proportional to the surface area and thus decreases in proportion to the square of the particle diameter. That is, the present inventors considered that simply increasing the coverage with the inorganic fine particle in order to lower the non-electrostatic adhesion of the toner, which has been proposed in the related art, improves the developability, but also decreases the low-temperature fixability and the trade-off cannot be avoided. The present inventors have further studied and found that the main factor of the decrease in developability and the main factor of the decrease in low-temperature fixability are different particle diameters in the toner distribution. Specifically, the main factor of the decrease in developability is fine powder having a low amount charged per particle. On the other hand, the main factor of the decrease in the low-temperature fixability is coarse powder having a large mass per particle. Therefore, the present inventors have found that by taking measures for the problem on each of the powers corresponding to their particle diameters, these characteristics can both be achieved.

A toner of the present disclosure has a median diameter (D50) on a number basis is 3.0 μm or more and 6.0 μm or less. When D50 is in the above range, dot reproducibility is improved and excellent image quality can be obtained. On the other hand, when D50 is less than 3.0 μm, the amount of the fine powder tends to increase and toner spent on a magnetic carrier occurs in long-term image output, which results in a decrease in developer fluidity or makes stable charging difficult such that excellent image quality is hardly obtained. When D50 is larger than 6.0 μm, the coarse powder, which has a large amount charged per particle from the viewpoint of the surface area and has a large electric field dependency, readily causes occurrence of scattering during development and transfer such that excellent image quality is hardly obtained.

Further, the toner of the present disclosure has the silica fine particle A on the surface of a toner particle containing a binder resin and the silica fine particle A has a median diameter on a number basis of 80 nm or more and 500 nm or less, which can be confirmed by a scanning electron microscope. When the particle diameter of the silica fine particle A is in the above range, the particle diameter ratio to the above-mentioned toner falls in an appropriate range and thus a good spacer effect is exhibited and the non-electrostatic adhesion can be lowered such that excellent developability is obtained. Further, when the particle diameter of the silica fine particle A is in the above range, the adhesion of the silica fine particle A to the toner particle becomes appropriate such that the detachment of the silica fine particle A is suppressed.

Further, for the toner of the present disclosure, when the toner is divided into two groups i.e. a first group and a second group, the first group including smaller size of the toner particle, and the second group including larger size of the toner particle, both particle groups satisfy the following requirements. The separation of the first group and the second group will be described later.

With respect to the first group, the average coverage $S_s$ with the silica fine particles A determined by image analysis of a scanning electron microscope is 20 area % or more and 70 area % or less. In addition, with respect to the second group, when the average coverage with the silica fine particle A determined by image analysis of the scanning electron microscope is set to $S_1$, the average coverage $S_s$ and the average coverage $S_1$ satisfy the following Expression (1).

$$S_1/S_s \leq 0.80 \quad (1)$$

When the average coverage $S_s$ is in the above range, the non-electrostatic adhesion of the fine powder serving as the main factor of the decrease in developability, can be suppressed to a low level such that excellent developability can be obtained. Further, when the average coverage $S_s$ and the average coverage $S_1$ satisfy Expression (1), in the coarse powder serving as the main factor of the decrease in low-temperature fixability, the coverage with the silica fine particle A which readily causes fixing inhibition, is relatively low such that excellent low-temperature fixability can be obtained. On the other hand, when the average coverage $S_s$ is less than 20 area %, the non-electrostatic adhesion cannot be lowered because the average coverage is too low, and thus excellent developability and suppression of fogging cannot be obtained. Further, when the average coverage $S_s$ is more than 70 area %, the amount of the silica fine particle A is excessively large and thus even though the fine powder is not the main factor of low-temperature fixability, the fixing inhibition is caused such that excellent low-temperature fixability cannot be obtained. This further facilitates the release of the silica fine particle A. Further, when the average coverage $S_s$ and the average coverage $S_1$ do not satisfy Expression (1), there is no difference between the average coverages on the fine powder side and on the coarse powder side and the trade-off between the low-temperature fixability and the developability cannot be avoided such that excellent effects achieving both cannot be obtained.

Further, in the toner of the present disclosure, it is more preferable that the average coverage $S_s$ and the average coverage $S_1$ satisfy the following Expression (2) from the viewpoint of achieving both the low-temperature fixability and the developability.

$$0.30 \leq S_1/S_s \leq 0.70 \quad (2)$$

Further, it is preferable that the toner of the present disclosure have 4.0 parts by mass or more and 7.0 parts by mass or less of the silica fine particle A based on 100 parts by mass of the toner particle from the viewpoint of the fixing inhibition and the amount of the free silica.

Further, in the toner of the present disclosure, it is preferable that the above-mentioned first group and second group satisfy the median adhesion index defined below. Here, "median adhesion index" is an index related to the non-electrostatic adhesion of toner.

When the median adhesion index of the first group is set to $I_s$ (mN/m) and the median adhesion index of the second group is set to $I_1$ (mN/m), $I_s$ is 3.0 mN/m or more and 6.0 mN/m or less, it is preferable that $I_s$ and $I_1$ satisfy the following Expression (3).

$$I_s/I_1 \leq 0.70 \quad (3)$$

When the median adhesion indexes satisfy the above-described requirements, both the low-temperature fixability and the developability are achieved more satisfactorily.

The median adhesion index $I_s$ being in the above range indicates that the non-electrostatic adhesion of the fine powder that serves as the main factor of the decrease in developability is small and thus excellent developability can be obtained.

Further, it is more preferable that $I_s/I_1$ satisfy the following Expression (4).

$$0.30 \leq I_s/I_1 \leq 0.60 \quad (4)$$

Further, it is preferable that in the toner of the present disclosure, the average coverage with the silica fine particle A and the average coverage with the silica fine particle A fixedly adhering to the toner surface in the above-mentioned first group and the second group satisfy the relationship defined below. Here, "average coverage with the silica fine particle A fixedly adhering to the toner surface" is an average coverage with the silica fine particle A remaining on the toner surface after the separation step of the silica fine particle A mentioned later is performed. When the average coverage with the fixedly adhering-silica fine particle A in the first group is set to $B_s$ and the average coverage with the fixedly adhering-silica fine particle A in the second group is set to $B_1$, it is preferable that the average coverages $B_s$ and $B_1$ and the above-mentioned average coverages $S_s$ and $S_1$ satisfy the following Expressions (5) and (6). In this case, excellent developability can be maintained even after the endurance.

$$0.25 \leq B_s \quad (5)$$

$$0.20 \leq (S_s - B_s) + (S_1 - B_1) \leq 0.35 \quad (6)$$

Further, in the present disclosure, by satisfying Expression (6), it is possible to provide a toner having both good toner fluidity and member contamination suppression properties. In order to impart the necessary fluidity to the toner, it is preferable that the silica fine particle A be able to move freely to some extent. Necessary fluidity can be imparted to the toner by the freely movable silica fine particle A being introduced between the toners to exhibit the function of rollers. In the Expression (6), $(S_s-B_s)+(S_1-B_1)$ represents the amount of the freely movable silica fine particle A in the toner, and when this value is 0.20 or more, excellent toner fluidity can be obtained. Meanwhile, by setting the value of $(S_s-B_s)+(S_1-B_1)$ to 0.35 or less, the amount of the silica fine particle A separated from the toner particle can be suppressed, and thus the member contamination suppression effect can be satisfactorily maintained.

Further, in the toner of the present disclosure, it is preferable that the silica fine particle A be fumed silica from the viewpoint of developability. In general, "fumed silica" is a dry silica produced by flame pyrolysis of chlorosilanes. On the other hand, sol-gel silica is mentioned as silica produced in wet environment with respect to silica produced in dry environment. In general, "sol-gel silica" is silica produced by reacting tetraalkoxysilane while supplying tetraalkoxysilane as a raw material in the presence of alcohol containing an alkali catalyst. In the fumed silica, hygroscopicity can be suppressed to a level lower than that of the sol-gel silica even under high temperature and high humidity environment. Meanwhile, the moisture absorbed on the toner surface causes an increase in non-electrostatic adhesion due to minute liquid crosslinking between the toner and the electrostatic latent image carrier and thus is preferably suppressed as much as possible from the viewpoint of non-electrostatic adhesion. Therefore, when the silica fine particle A is fumed silica, the hydrophobicity of the toner is increased, the amount of moisture adsorbed under high temperature and high humidity environment is reduced, and the non-electrostatic adhesion can be suppressed to a low level such that excellent developability can be obtained.

Further, in the toner of the present disclosure, when the cumulative 90% particle diameter on a number basis is set to D90 and the cumulative 10% particle diameter on a number basis is set to D10, it is preferable that the span value obtained by the following Expression (7) be 0.2 or more and 0.8 or less from the viewpoint that the suppression of fogging and the excellent image quality are easily obtained. It is more preferable that the span value be 0.2 or more and 0.7 or less. When the span value is in the above range, it is indicated that the particle size distribution is sharp and there is little excessively small fine powder in which the amount charged per particle is considerably small such that excellent developability is obtained. Further, since there is little excessively large coarse powder in which the amount charged per particle is considerably large, scattering during development or transfer is suppressed such that excellent image quality can be obtained.

$$\text{Span value} = (D90 - D10)/D50 \quad (7)$$

Further, it is preferable that the toner of the present disclosure contain a graft polymer having a polyolefin as a trunk and a styrene acrylic polymer as a branch. When the toner contains the polymer, when the surface treatment is performed with hot air using the surface treatment apparatus (thermal spheronization treatment apparatus) illustrated in FIGURE, the release agent becomes a driving force and the branches are aligned on the toner particle surface. Since this polymer has a Tg higher than that of the main binder, a core-shell structure having a hard shell can be formed. Therefore, the non-electrostatic adhesion can be suppressed to a low level such that excellent developability can be obtained. Further, it is more preferable that the styrene acrylic polymer have a unit derived from a cycloalkyl (meth)acrylate from the viewpoint of developability. When the toner has the above-described polymer unit, the hydrophobicity of the toner is increased, the amount of moisture adsorbed under high temperature and high humidity environment is reduced, and the non-electrostatic adhesion can be suppressed to a low level such that excellent developability can be obtained.

Further, it is preferable that the toner of the present disclosure be surface-treated with hot air using, for example, the surface treatment apparatus illustrated in FIGURE from the viewpoint of suppression of fogging. Since the toner particle is treated with hot air in a hydrophobic field in the air by the surface treatment apparatus illustrated in FIGURE, the release agent, which is a constituent material for the toner, moves to the vicinity of the toner particle surface, the hydrophobicity of the toner surface is increased, the amount of moisture adsorbed under high temperature and high humidity environment is reduced, and the non-electrostatic adhesion can be suppressed to a low level such that excellent developability can be obtained.

<Binder Resin>

For the toner particle in the present disclosure, the following polymers, for example, can be used as a binder resin. Examples thereof include homopolymers of styrene or substituted styrene such as polystyrene, poly-p-chlorostyrene, and polyvinyl toluene; styrene-based copolymers such as styrene-p-chlorostyrene copolymer, styrene-vinyltoluene copolymer, styrene-vinyl naphthalene copolymer, styrene-acrylic acid ester copolymer and styrene-methacrylic acid ester copolymer; polyvinyl chloride, phenolic resin, natural resin modified phenolic resin, natural resin modified maleic resin, acrylic resin, methacrylic resin, polyvinyl acetate, silicone resin, polyester, polyurethane, polyamide resin, furan resin, epoxy resin, xylene resin, polyethylene and polypropylene. Among them, it is preferable that polyester be the main component from the viewpoint of low-temperature fixability.

As monomers used for polyester, polyhydric alcohols (dihydric or higher polyhydric alcohols), polycarboxylic acids (dicarboxylic or higher carboxylic acids), acid anhydrides thereof or lower alkyl esters thereof are used. Here, in order to make a branched polymer to develop "strain-hardening", partial crosslinking within the molecules of the amorphous resin is effective, and for that purpose, a trifunctional or higher polyfunctional compound is preferably used. Therefore, it is preferable to contain a tricarboxylic or higher polycarboxylic acid, an acid anhydride thereof or a lower alkyl ester thereof, and/or a trihydric or higher polyhydric alcohol as a raw material monomer of polyester.

The following polyhydric alcohol monomers may be used as a polyhydric alcohol monomer used for polyester.

Examples of the dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol represented by Formula (A) and derivatives thereof;

(A)

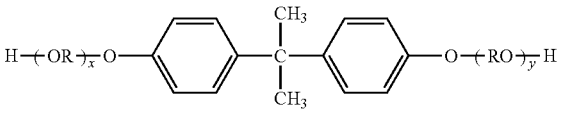

(in the formula, R is an ethylene or propylene group, x and y are each an integer of 0 or more, and the average value of x+y is 0 or more and 10 or less), and, diols represented by Formula (B);

(B)

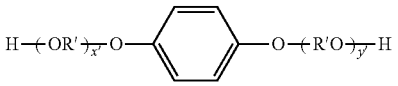

(in the formula, R' represents —$CH_2CH_3$—, —$CH_2$—CH($CH_3$)—, or —$CH_2C(CH_3)_2$—, x' and y' are an integer of 0 or more, and the average value of x+y is 0 to 10).

Examples of the trihydric or higher polyhydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene. Among these, glycerol, trimethylolpropane and pentaerythritol are preferably used. These dihydric alcohols and trihydric or higher polyhydric alcohols may be used alone or in combination of two or more.

The following polycarboxylic acid monomers may be used as a polycarboxylic acid monomer used for polyester.

Examples of the dicarboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, anhydrides of these acids and their lower alkyl esters. Among these, maleic acid, fumaric acid, terephthalic acid and n-dodecenyl succinic acid are preferably used.

Examples of tricarboxylic or higher polycarboxylic acid, and acid anhydrides thereof or lower alkyl ester thereof include 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylenecarboxypropane, 1,2,4-cyclohexanetricarboxylic acid, tetra(methylene carboxyl) methane, 1,2,7,8-octane tetracarboxylic acid, pyromellitic acid, Empol trimer acid, and acid anhydrides thereof or lower alkyl esters thereof. Among these, 1,2,4-benzenetricarboxylic acid, that is, trimellitic acid or a derivative thereof, which is inexpensive and the reaction control is easy, is particularly preferably used. These dicarboxylic alcohols and tricarboxylic or higher polycarboxylic alcohols may be used alone or in combination of two or more.

A method for producing the polyester of the present disclosure is not particularly limited, and a known method may be used. For example, the above-mentioned alcohol monomer and carboxylic acid monomer are simultaneously charged and polymerized through an esterification reaction or a transesterification reaction, and a condensation reaction to produce a polyester resin. Further, the polymerization temperature is not particularly limited, but is preferably in the range of 180° C. or more and 290° C. or less. In the polymerization of polyester, for example, a polymerization catalyst such as a titanium-based catalyst, a tin-based catalyst, zinc acetate, antimony trioxide, germanium dioxide or the like may be used. In particular, the amorphous resin of the present disclosure is more preferably polyester polymerized using the tin-based catalyst.

In addition, it is preferable that the acid value of polyester be 5 mg KOH/g or more and 20 mg KOH/g or less, and the hydroxyl value be 20 mg KOH/g or more and 70 mg KOH/g or less from the viewpoint of suppression of fogging because the amount of moisture adsorbed under high temperature and high humidity environment can be suppressed and the non-electrostatic adhesion can be suppressed to a low level.

Further, the amorphous resin may be used by mixing a low molecular weight resin and a high molecular weight resin. It is preferable that the content ratio of the high molecular weight resin to the low molecular weight resin be preferably 40/60 or more and 85/15 or less on a mass basis from the viewpoint of low-temperature fixability and hot offset resistance.

<Release Agent>

Examples of the wax used for the toner include: hydrocarbon-based wax such as low molecular weight polyethylene, low molecular weight polypropylene, alkylene copolymer, microcrystalline wax, paraffin wax, Fischer Tropsch wax; oxide of hydrocarbon-based wax such as oxidized polyethylene wax or block copolymers thereof; waxes having fatty acid esters as the main component such as carnauba wax; and deoxidized wax obtained by deoxidizing a part or all of fatty acid esters such as deoxidized carnauba wax. Examples thereof further include: saturated linear fatty acids such as palmitic acid, stearic acid, and montanic acid; unsaturated fatty acids such as brassidic acid, eleostearic acid and valinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, ceryl alcohol, and melissyl alcohol; fatty acid amides such as linoleic acid amide, oleic acid amide and lauric acid amide; saturated fatty acid bisamides such as methylenebisstearic acid amide, ethylenebiscapric acid amide, ethylene bis lauric acid amide and hexamethylene bis stearic acid amide; unsaturated fatty acid amides such as ethylene bis oleic acid amide, hexamethylene bis oleic acid amide, N,N'-dioleyl adipic acid amide and N,N'-dioleyl sebacic acid amide; aromatic bisamides such as m-xylene bis-stearic acid amide and N,N'-distearyl isophthalic acid amide; aliphatic metal salts such as calcium stearate, calcium laurate, zinc stearate, magnesium stearate (generally referred to as metal soaps); waxes in which vinyl monomers such as styrene and acrylic acid are grafted onto aliphatic hydrocarbon waxes; partially esterified compounds of a fatty acid and a polyhydric alcohol such as behenic acid monoglyceride; and methyl ester compounds having hydroxyl groups and obtained by hydrogenation of vegetable fats and oils.

Among these waxes, hydrocarbon-based waxes such as paraffin wax and Fischer Tropsch wax, or fatty acid ester waxes such as carnauba wax are preferable from the viewpoint of improving low-temperature fixability and releasing property. In the present disclosure, hydrocarbon-based waxes are more preferable in that the hot offset resistance is further improved.

The wax is preferably used in an amount of 3 parts by mass or more and 8 parts by mass or less based on 100 parts by mass of the binder resin.

Further, in the endothermic curve at the time of heating measured with a differential scanning calorimetry (DSC) apparatus, the peak temperature of the maximum endothermic peak of the wax is preferably 45° C. or more and 140° C. or less. It is preferable that the peak temperature of the maximum endothermic peak of the wax is in the above-described range because both the storage stability of the toner and the hot offset resistance can be achieved.

<Colorant>

The toner particle may contain a colorant. Examples of the colorant include the followings.

Examples of the black colorant include carbon black; and those toned to black using a yellow colorant, a magenta colorant and a cyan colorant. Although a pigment may be used alone as the colorant, it is more preferable to improve the sharpness by using a dye and a pigment in combination from the viewpoint of the image quality of a full color image.

Examples of the pigment for the magenta toner include the followings: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57: 1, 58, 60, 63, 64, 68, 81:1, 83, 87, 88, 89, 90, 112, 114, 122, 123, 146, 147, 150, 163, 184, 202, 206, 207, 209, 238, 269, 282; C. I. Pigment Violet 19; and C. I. Vat Red 1, 2, 10, 13, 15, 23, 29, 35.

Examples of the dye for the magenta toner include the followings: C. I. Solvent Red 1, 3, 8, 23, 24, 25, 27, 30, 49, 81, 82, 83, 84, 100, 109, 121; C. I. Disperse Red 9; C.I. Solvent Violet 8, 13, 14, 21, 27; Oil-soluble dyes such as C.I. Disperse Violet 1, C.I. Basic Red 1, 2, 9, 12, 13, 14, 15, 17, 18, 22, 23, 24, 27, 29, 32, 34, 35, 36, 37, 38, 39, 40; and basic dyes such as C. I. Basic Violet 1, 3, 7, 10, 14, 15, 21, 25, 26, 27, 28.

Examples of the pigment for the cyan toner include the followings: C. I. Pigment Blue 2, 3, 15:2, 15:3, 15:4, 16, 17; C. I. Vat Blue 6; C. I. Acid Blue 45; and copper phthalocyanine pigment having a phthalocyanine skeleton substituted with 1 to 5 phthalimidomethyl groups.

Examples of the dye for the cyan toner include C. I. Solvent Blue 70.

Examples of the pigment for the yellow toner include the followings: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C. I. Vat Yellow 1, 3, 20.

Examples of the dye for the yellow toner include C. I. Solvent Yellow 162.

These colorants may be used alone or in combination, or in the form of a solid solution. The colorant is selected from the viewpoint of hue angle, saturation, brightness, light fastness, OHP transparency, and dispersibility in toner.

It is preferable that the content of the colorant be 0.1 parts by mass or more and 30.0 parts by mass or less with respect to the total amount of the resin component.

<Inorganic Fine Particle>

The toner may contain an inorganic fine particle other than the silica fine particle A as necessary.

The inorganic fine particle may be internally added to the toner particle or may be mixed with the toner particle as an external additive.

The external additive is preferably an inorganic fine particle such as silica, titanium oxide and aluminum oxide. The inorganic fine particle is preferably hydrophobized with a hydrophobizing agent such as a silane compound, silicone oil or a mixture thereof.

As an external additive for improving fluidity, an inorganic fine particle having a specific surface area of 50 $m^2/g$ or more and 400 $m^2/g$ or less is preferred.

A known mixer such as a Henschel mixer may be used to mix the toner particle with the external additive.

<Developer>

The toner may be used also as a one-component developer, but in order to further improve dot reproducibility, and in order to supply a stable image over a long period, the toner may be mixed with a magnetic carrier and used as a two-component developer.

As the magnetic carrier, generally known magnetic carriers such as iron oxide; a metal particle such as iron, lithium, calcium, magnesium, nickel, copper, zinc, cobalt, manganese, chromium, and rare earths, an alloy particle thereof, an oxide particle thereof; a magnetic material such as ferrite; a magnetic material-dispersed resin carrier (so-called resin carrier) containing a magnetic material and a binder resin for holding the magnetic material in a dispersed state; and the like may be used.

When the toner is mixed with a magnetic carrier and used as the two-component developer, the toner concentration is preferably 2 mass % or more and 15 mass % or less, and more preferably 4 mass % or more and 13 mass % or less.

<Method of Producing Toner>

The method of producing a toner particle is not particularly limited, but the pulverization method is preferable from the viewpoint of the dispersibility of the release agent and the polymer in which a styrene acrylic polymer is graft-polymerized to a polyolefin. The reason is that when a toner particle is produced in an aqueous medium, the releasing agent, which is highly hydrophobic, or the polymer in which a styrene acrylic polymer is graft-polymerized to a polyolefin tends to be localized inside the toner particle, and therefore, it becomes difficult to form the core-shell structure by the above-mentioned heat treatment apparatus.

Hereinafter, the toner production procedure in the pulverization method will be described.

In the raw material mixing step, predetermined amounts of materials constituting a toner particle, for example, a binder resin, a release agent, a colorant and a crystalline polyester and, as necessary, other components such as a charge control agent are weighed and blended to mix the components. Examples of the mixing apparatus include a double cone mixer, a V-type mixer, a drum mixer, a super mixer, a Henschel mixer, a Nauta mixer and Mechano Hybrid (manufactured by Nippon Coke & Engineering Co., Ltd.).

Next, the mixed material is melt-kneaded to disperse wax and the like in the binder resin. In the melt-kneading step, a batch-type kneader such as a pressure kneader or a Banbury mixer, or a continuous-type kneader may be used, and a single-screw or twin-screw extruder becomes the mainstream because of its superiority of continuous production. For example, a KTK type twin-screw extruder (manufactured by Kobe Steel, Ltd.), a TEM type twin-screw extruder (manufactured by Toshiba Machine Co., Ltd.), a PCM kneader (manufactured by Ikegai Ironworks Corp.), a twin-screw extruder (manufactured by KCK Co., Ltd.), Co-Kneader (manufactured by Buss AG) and Kneadex (manufactured by Nippon Coke & Engineering Co., Ltd.). Furthermore, the resin composition obtained by melt-kneading may be rolled by a two-roll mill or the like, and may be cooled by water or the like in the cooling step.

Next, the cooled product of the resin composition is pulverized to a desired particle diameter in the pulverizing step. In the pulverizing step, for example, after coarsely pulverizing with a pulverizer such as a crusher, a hammer mill and a feather mill, the cooled product is further finely pulverized with a fine pulverizer such as Krypton system (manufactured by Kawasaki Heavy Industries, Ltd.), Super Rotor (manufactured by Nisshin Engineering Inc.) and Turbo Mill (manufactured by Turbo Kogyo Co., Ltd.) or using an air jet method.

Thereafter, classification is performed using a classifier or a sieving machine such as inertial classification type Elbow jet (manufactured by Nittetsu Mining Co., Ltd.), centrifugal classification type Turboplex (manufactured by Hosokawa Micron Corporation), TSP separator (manufactured by Hosokawa Micron Corporation), Faculty (manufactured by Hosokawa Micron Corporation) as necessary.

Thereafter, surface treatment of the toner particle by heating is performed to increase the circularity of the toner. For example, surface treatment may also be performed by hot air using the thermal spheronization treatment apparatus illustrated in FIGURE.

A mixture supplied in a constant amount by a constant amount raw material supply unit 1 is led to an introduction pipe 3 installed on the vertical line of the raw material supply unit by compressed gas adjusted by a compressed gas flow rate adjustment unit 2. The mixture having passed through the introduction pipe 3 is uniformly dispersed by a conical projection member 4 provided at the central portion of the raw material supply unit, and is introduced into radially extending eight-direction supply pipes 5 and led to a treatment chamber 6 where the heat treatment is performed.

At this time, the flow of the mixture supplied to the treatment chamber 6 is regulated by a regulating unit 9 for regulating the flow of the mixture provided in the treatment chamber 6. Thus, the mixture supplied to the treatment chamber 6 is cooled after being heat-treated while turning in the treatment chamber 6.

The hot air for heat-treating the supplied mixture is supplied from a hot air supply unit 7, uniformly distributed by a distribution member 12, and the hot air is spirally turned and introduced into the treatment chamber 6 by a turning member 13 for turning the hot air toward a hot air supply unit outlet 11. As the constitution, the turning member 13 for spirally turning the hot air has a plurality of blades, and the turning of the hot air may be controlled by the number and angle of the blades. The temperature of the hot air to be supplied into the treatment chamber 6 at an outlet portion of the hot air supply unit 7 is preferably 100° C. to 300° C. When the temperature at the outlet portion of the hot air supply unit 7 is within the above-described range, the toner particle can be uniformly spheroidized while preventing fusion or coalescence of the toner particle due to excessive heating of the mixture.

The heat-treated toner particle subjected to the heat treatment are cooled by cold air supplied from cold air supply units 8-1, 8-2, and 8-3. The temperature supplied from the cold air supply units 8-1, 8-2, and 8-3 is preferably −20° C. to 30° C. When the temperature of the cold air is within the above range, the heat-treated toner particle can be efficiently cooled, and fusion or coalescence of the heat-treated toner particle can be prevented without inhibiting uniform spheroidization of the mixture. It is preferable that the absolute moisture content of the cold air be 0.5 $g/m^3$ or more and 15.0 $g/m^3$ or less.

Next, the cooled heat-treated toner particle is collected by a collection unit 10 at a lower end of the treatment chamber 6. In addition, a blower (not shown) is provided at a tip of the collection unit 10 and the toner particle is thereby suctioned and transported.

In addition, a powder particle supply port 14 is provided such that the turning direction of the supplied mixture and the turning direction of the hot air are the same, and the collection unit 10 of the thermal spheronization treatment apparatus is provided on an outer peripheral portion of the treatment chamber such that the turning direction of the turned powder particle is maintained. Furthermore, the cold air supplied from the cold air supply units 8-1, 8-2 and 8-3 is supplied horizontally and tangentially from the outer peripheral portion of the apparatus to an inner peripheral surface of the treatment chamber. The turning direction of the toner particle supplied from the powder particle supply port 14, the turning direction of the cold air supplied from the cold air supply units 8-1, 8-2 and 8-3, and the turning direction of the hot air supplied from the hot air supply unit 7 are all the same. Therefore, turbulent flow does not occur in the treatment chamber 6, the turning flow in the apparatus is reinforced, strong centrifugal force is applied to the toner particle, and the dispersibility of the toner is further improved such that a uniform toner particle without coalesced particle can be obtained.

Here, it is preferable that the average circularity of the toner particle be 0.960 or more and 0.980 or less from the viewpoint of suppression of fogging because the non-electrostatic adhesion can be suppressed to a low level.

Thereafter, the toner particles are divided into two groups of fine powder and coarse powder. For example, the toner particles are divided into two groups using an inertial classification type Elbow jet (manufactured by Nittetsu Mining Co., Ltd.). Thereafter, a desired amount of a silica fine particle A is externally added to treat the surface of each of the heat-treated toner particles divided into two groups. Examples of the method of external addition for treatment include a method of stirring and mixing using a mixing apparatus for the external addition such as a double cone mixer, a V-type mixer, a drum mixer, a super mixer, a Henschel mixer, a Nauta mixer, Mechano Hybrid (manufactured by Nippon Coke & Engineering Co., Ltd.) and Nobilta (manufactured by Hosokawa Micron Corporation). At that time, a fluidizing agent may be externally added for treatment as necessary.

The methods for measuring various material properties of the toner and the raw material will be described below.

<Measurement of Median Diameter (D50) on Number Basis, Average Coverage $S_s$ and Average Coverage $S_1$ of Toner and Silica Fine Particle A>

Median diameter (D50) on a number basis, the average coverage $S_s$ and the average coverage $S_1$ of the toner and silica fine particle A may be determined by observing a secondary electron image with a scanning electron microscope and subsequent image processing.

The median diameter (D50) on a number basis, the average coverage $S_s$ and the average coverage $S_1$ of the toner and silica fine particle A were measured using a scanning electron microscope (SEM), S-4800 (manufactured by Hitachi, Ltd.). The area ratio of the portion derived from the silica fine particle A is calculated mainly by image processing of a portion with high luminance at an acceleration voltage of 2.0 kV.

Specifically, a toner was fixed in a single layer with a carbon tape on a sample stage for electron microscope observation, vapor deposition with platinum was performed on the toner, and the toner was observed by using the scanning electron microscope S-4800 (manufactured by Hitachi, Ltd.) under the following conditions. The observation was performed after flushing operation.

Signal Name=SE (U, LA80)
Accelerating Voltage=2000 Volt
Emission Current=10000 nA
Working Distance=6000 um
Lens Mode=High
Condencer 1=5
Scan Speed=Slow 4 (40 seconds)
Magnification=50000
Data Size=1280×960
Color Mode=Grayscale As the secondary electron image, the projected image of the toner was obtained by adjusting the brightness to 'contrast 5, brightness-5' on the control software of the scanning electron microscope S-4800, and setting capture speed/total number of sheets to 'Slow 4 for 40 seconds' as an 8-bit 256 gradation gray scale image of image size 1280×960 pixels. From the scale on the image, the length of 1 pixel is 0.02 μm, and the area of 1 pixel is 0.0004 $\mu m^2$.

Subsequently, the projected area circle equivalent diameter of the toner, the area ratio (area %) of the portion derived from the silica fine particle A and the projected area circle equivalent diameter of the silica fine particle A were calculated for 100 toner particles using the projected image obtained by the secondary electrons. Details of the method for selecting 100 toner particles to be analyzed will be described later. The image processing software Image-Pro Plus 5.1 J (manufactured by Media Cybernetics, Inc.) was used for obtaining the area % of the portion derived from the silica fine particle A.

Next, the portion of the toner particle group was extracted, and the size of one extracted toner particle was counted. Specifically, first, in order to extract a toner particle group to be analyzed, the toner particle group and the background portion are separated. "Measure"—"Count/Size" is selected in Image-Pro Plus 5.1 J. In the "Select Luminance Range" of "Count/Size", the luminance range was set in the range of 50 to 255 to extract the toner particle group by excluding the carbon tape portion with low luminance reflected as a background. When the toner particle group is fixed by a method other than the carbon tape, the background does not necessarily become an area with low luminance or the possibility that the luminance is partially similar to that of the toner particle group cannot be ruled out. However, the boundary between the toner particle group and the background can be easily distinguished from the secondary electron observation image. When performing extraction, in the extraction option in "Count/Size", "4 connected" was selected, "5" for smoothness was input and "fill in holes" was checked to exclude the toner particle located on all boundaries (outer periphery) of the image and toner particle overlapping with other toner particles from the calculation. Next, the area and Feret diameter (average) were selected in the measurement items of "Count/Size", and each particle of toner to be subjected to image analysis was extracted with the selection range of the area being a minimum of 100 pixels and a maximum of 10000 pixels. One toner particle was selected from the extracted toner particle group, and the size $ja_1$ (number of pixels) of the portion derived from the particle was determined. Projected area circle equivalent diameter $d_1$ from the obtained $ja_1$ using the following Expression.

$$d_1=\{(4\times ja_1\times 0.3088)/3.14\}^{0.5}$$

Next, in the "Select Luminance Range" of "Count/Size" in Image-Pro Plus 5.1 J, the luminance range was set in the range of 140 to 255 to extract a portion with high luminance on one toner particle. By setting the selection range of the area to a minimum of 1 pixels and a maximum of 200 pixels, a portion with high luminance derived from the silica fine particle A can be extracted.

The size $ma_1$ (number of pixels) of the portion of the toner surface derived from the silica fine particle A was determined for the toner particle selected when determining $ja_1$. "$ma_1$" is the total area of the extracted portions derived from the silica fine particle A scattered in a certain size in each toner particle. From the obtained $ma_1$, the coverage "s" of the silica fine particle A was obtained using the following Expression.

$$s=(ma_1/ja_1)\times 100$$

Further, a size $na_1$ of a portion derived from one particle of the silica fine particle A was determined. By employing $na_1$ obtained, projected area circle equivalent diameter $r_1$ was determined using the following Expression.

$$r_1=\{(4\times na_1\times 0.0003088)/3.14\}^{0.5}$$

Next, the same processing was performed on each particle of the extracted particle group until the number of toner particles selected became 100. When the number of toner particles in one field of view was less than 100, the same operation was repeated for the toner projection image of another field of view.

The obtained 100 toner particles were arranged in ascending order of the projected area circle equivalent diameters, and the projected area circle equivalent diameter of the 50th toner particle was set to the median diameter (D50) on a number basis of the toner of the present disclosure. Similarly, the obtained 100 toner particles were arranged in ascending order of the projected area circle equivalent diameters of all silica fine particle A, the projected area circle equivalent diameter of the silica fine particle A account for half the total diameters was set to the median diameter (D50) on a number basis of the silica fine particle A. In the case when the external additive other than the silica fine particle A is included, the silica fine particle A was specified from a shape or size (of particles having 50 nm or more).

Further, the average value of the coverages s of the first to 50th toner particles arranged in ascending order of the projected area circle equivalent diameters was set to the average coverage $S_s$ of the silica fine particle A determined by image analysis of the first group with a scanning electron microscope. Similarly, the average value of the coverages s of the 51st to 100th toner particles arranged in ascending order of the projected area circle equivalent diameters was set to the average coverage $S_1$ of the silica fine particle A determined by image analysis of the second group with a scanning electron microscope.

<Measurement Method of Average Circularity of Toner>

The average circularity of the toner is measured by a flow type particle image analyzer "FPIA-3000" (manufactured by Sysmex Corporation) under the measurement and analysis conditions at the time of the calibration operation.

The measurement principle of the flow type particle image analyzer "FPIA-3000" (manufactured by Sysmex Corporation) is to perform image analysis by imaging a flowing particle as a still image. The sample added to the sample chamber is fed into the flat sheath flow cell by a sample suction syringe. The sample fed into the flat sheath flow cell is sandwiched by the sheath liquid to form a flat flow. The sample passing through the flat sheath flow cell is irradiated with a strobe light at intervals of 1/60 seconds, and it is possible to capture a flowing particle as a still image. Also, since the flow is flat, the image is captured in focus. The particle image is imaged by a CCD camera, and the imaged image is subjected to image processing with an image processing resolution of 512×512 pixels (0.37×0.37 μm per pixel), and the outline of each particle image is extracted, and the projected area S, the peripheral length L and the like of the particle image are measured.

Next, the circle equivalent diameter and the degree of circularity are determined using the above-described projected area S and peripheral length L. The term "circle equivalent diameter" is the diameter of a circle having the same area as the projected area of the particle image, and the circularity C is defined as a value obtained by dividing the peripheral length of the circle determined from the circle equivalent diameter by the peripheral length of the particle projection image and calculated by the following Expression.

$$\text{Circularity } C=2\times(\pi\times S)^{1/2}/L$$

When the particle image is circular, the circularity is 1.000, and the circularity decreases as the degree of unevenness on the periphery of the particle image increases. After calculating the circularity of each particle, the arithmetic mean value of the obtained degrees of circularity is calculated, and the value is defined as the average circularity.

The specific measuring method is as follows.

First, about 20 mL of ion exchange water from which impure solids and the like have been removed in advance is placed in a glass container. About 0.2 mL of a diluted solution obtained by diluting "Contaminon N" (10 mass % aqueous solution of neutral detergent at pH 7 for cleaning precision measuring instrument including nonionic surfactant, anionic surfactant and organic builders, manufactured by Wako Pure Chemical Industries, Ltd.) about 3 times by mass with ion exchange water is added thereto as a dispersant.

Further, about 0.02 g of a measurement sample is added, and a dispersion treatment is performed for 2 minutes using an ultrasonic dispersion apparatus to obtain a dispersion for measurement. At that time, the dispersion is suitably cooled such that the temperature of the dispersion becomes 10° C. or more and 40° C. or less. Using a desktop ultrasonic cleaner dispersion apparatus ("VS-150" (manufactured by Velvo-Clear)) having an oscillation frequency of 50 kHz and an electric output of 150 W as the ultrasonic dispersion apparatus, a predetermined amount of ion exchange water is placed in the water bath and about 2 mL of the Contaminon N is added into the water bath.

For the measurement, a flow type particle image analyzer equipped with a standard objective lens (10×) is used, and a particle sheath "PSE-900A" (manufactured by Sysmex Corporation) is used as a sheath liquid. The dispersion prepared according to the above-described procedure is introduced into the flow type particle image analyzer, and 3000 toner particles are measured in the total count mode in the HPF measurement mode.

Then, the binarization threshold value at the time of particle analysis is set to 85%, the analysis particle diameter is set to 1.98 μm or more and 39.96 μm or less of circle equivalent diameter to determine the average circularity of the toner.

In the measurement, automatic focusing is performed using standard latex particles (for example, "RESEARCH AND TEST PARTICLES Latex Microsphere Suspensions 5200A" manufactured by Duke Scientific Corporation diluted with ion exchange water) before the start of the measurement. Thereafter, it is preferable to perform focusing every two hours from the start of measurement.

<Measurement of Median Adhesion Index $I_s$ and Median Adhesion Index $I_1$>

The method of measuring the adhesion of the toner is generally a method of estimating the force required to separate the toner from the object to which the toner is adhering. As a method of separating toner, a method using centrifugal force, vibration, impact, air pressure, electric field, magnetic field or the like is known. Among them, the method using centrifugal force is easy to quantify and has high measurement accuracy. Thus, in the present disclosure, as a method of measuring the adhesion of toner, a centrifugal method using centrifugal force was used. Hereinafter, the toner adhesion measurement method by the centrifugal method will be described.

The median adhesion index $I_s$ and the median adhesion index $I_1$ were measured using a centrifugal adhesion measuring apparatus "NS-C100" (manufactured by Nano Seeds Corporation) according to the operation manual. Here, the apparatus is roughly configured of an image analysis section and a centrifugal separation section. The image analysis section is configured of a metallographic microscope, an image analysis apparatus, and a video monitor. The centrifugal separation section is configured of a high-speed centrifuge and a sample cell (made of aluminum A5052). The sample cell is configured of a sample substrate having a sample surface to which a toner is adhered, a receiving substrate having an adhering surface to which the toner separated from the sample substrate is to be adhered and a spacer between the sample surface of the sample substrate and the adhering surface of the receiving substrate. The centrifugal separation section includes a rotor that rotates the measurement cell and a holding member. The rotor has a sample mounting portion for setting the holding member, the sample mounting portion having a hole shape in a cross section perpendicular to the central axis thereof. The holding member includes a rod-like portion, a cell holding portion that is provided on the rod-like portion and holds the measurement cell, and a hole for pushing the measurement cell out of the cell holding portion. The cell holding portion is configured such that a direction perpendicular to the measurement cell is perpendicular to the rotation center axis of the rotor when the measurement cell is mounted.

Specifically, when the sample cell with the toner adhering to the sample substrate and the holding member are mounted in the sample mounting portion of the rotor, the cell holding portion of the holding member is mounted such that the sample substrate is disposed between the receiving substrate and the rotation center axis of the rotor. The holding member is mounted on the sample mounting portion of the rotor such that a direction perpendicular to the measurement cell is perpendicular to the rotation center axis of the rotor. The centrifuge is operated to rotate the rotor at a constant rotation speed. Thereafter, the sample cell is taken out and set in the image analysis section, and the separated state of the toner is recorded. From the image analysis result, the projected area circle equivalent diameter d of the separated toner is calculated. The toner adhering to the sample substrate receives a centrifugal force corresponding to the number of rotations, and when the centrifugal force received by the toner is larger than the adhesion between the toner and the sample surface, the toner separates from the sample surface and adheres to the adhering surface. Since the centrifugal force applied to the toner at the time when the toner was separated from the sample substrate is equal to the adhesion, the centrifugal force at that time was calculated and regarded as the adhesion.

The centrifugal force Fr received by the toner is determined from the following Expression using the mass m of the toner, the rotation speed f of the rotor (rpm), and the distance r from the central axis of the rotor to the toner-adhering surface of the sample substrate.

$$Fr=m\times r\times(2\pi fr/60)^2$$

The mass m of the toner is determined from the following Expression using the true specific gravity p of the toner and the projected area circle equivalent diameter d.

$$m=(\pi/6)\times\rho\times d^3$$

From the above-described Expression, the centrifugal force Fr received by the toner is determined from the following Expression.

$$Fr=(\pi^3/5400)\times\rho\times d^3\times r\times f^2$$

The particle diameter and adhesion F (centrifugal force Fr) of 300 toner particles are calculated. The adhesion generally decreases as the particle diameter decreases, so in order to eliminate the dependence of the particle diameter, normalization is performed by dividing the adhesion F by the particle diameter d to calculate the median adhesion index (I).

Next, the obtained 300 toner particles are divided into a particle group having projected area circle equivalent diameters d of D50 (values specified in <Measurement of Median Diameter (D50) on Number Basis, Average Coverage $S_s$ and Average Coverage $S_1$ of Toner> are employed) or less (first group) and a particle group having projected area circle equivalent diameters d larger than D50 (second group).

Further, for the toner of the particle group of D50 or less, the median adhesion index when adhesion indexes were arranged in ascending order was set to the median adhesion index $I_s$ of the first group of the particle diameter of D50 or less of the toner of the present disclosure and determined by the centrifugal adhesion measuring apparatus. Similarly, for the toner of the particle group of larger than D50, the median adhesion index when adhesion indexes were arranged in ascending order was set to the median adhesion index $I_1$ of the second group of the particle diameter of larger than D50 of the toner of the present disclosure and determined by the centrifugal adhesion measuring apparatus.

<Measurement Method of Average Coverage>

In the present disclosure, the fixedly adhering silica fine particle is measured and defined as follows. Into a 30 cc glass vial (for example, VCV-30, outer diameter: 35 mm, height: 70 mm, manufactured by Nichiden Rika-Glass Co., Ltd.), 20 g of ion exchange water, 0.4 g of Contaminon N serving as a surfactant (10 mass % aqueous solution of neutral detergent at pH 7 for cleaning precision measuring instrument including nonionic surfactant, anionic surfactant and organic builders, manufactured by Wako Pure Chemical Industries, Ltd.) were placed and thoroughly mixed to prepare a dispersion. To this vial, 1.0 g of toner is added, and the vial is allowed to stand until the toner naturally settles to prepare a pre-treatment dispersion. It is assumed that in this dispersion, a silica fine particle that is not separated off even when shaken for 5 minutes at a shaking speed of 46.7 cm/sec and a shaking width of 4.0 cm be fixedly adhered. The separation of the toner in which the silica fine particle remains and the detached silica fine particle is performed using a centrifuge. The centrifugation step was performed at 3700 rpm for 30 minutes. The toner in which the silica fine particle remained was collected and dried to obtain a toner after separation.

In the same manner as in the measurement of the average coverage $S_s$ and the average coverage $S_1$ except using dried toner, the average coverage $S_{st}$ of the first group and the average coverage Sit of the second group were measured based on the fixedly adhering-silica fine particle A. At this time, the first group and the second group refer to a particle group having a diameter of D50 or less and a particle group having a diameter larger than D50 using D50 specified in <Measurement of Median Diameter (D50) on Number Basis, Average Coverage $S_s$ and Average Coverage $S_1$ of Toner and Silica Fine Particle A>.

The average coverage $B_s$ (%) of the first group and the average coverage $B_1$ (%) of the second group are determined from the following Expressions.

$$B_s=S_{st}/S_s\times 100$$

$$B_1=S_{st}/S_1\times 100$$

EXAMPLES

<Production Example of Amorphous Resin 1>

Polyoxypropylene (2.2)-2,2-bis(4-hydroxyphenyl) propane: 73.8 parts by mass (0.19 mol; 100.0 mol % with respect to the total number of moles of polyhydric alcohol)

Terephthalic acid: 12.5 parts by mass (0.08 mol; 48.0 mol % with respect to the total number of moles of polycarboxylic acid)

Adipic acid: 7.8 parts by mass (0.05 mol; 34.0 mol % with respect to the total number of moles of polycarboxylic acid)

Titanium tetrabutoxide (esterification catalyst): 0.5 parts by mass

The above materials were charged into a reaction vessel to which a cooling pipe, a stirrer, a nitrogen introducing pipe, and a thermocouple were attached. Next, after the inside of the flask was replaced with nitrogen gas, the temperature was gradually raised while stirring, and reaction was performed for 2 hours while stirring at a temperature of 200° C.

Further, the pressure in the reaction vessel was lowered to 8.3 kPa and maintained for 1 hour, then cooled to 160° C. and returned to atmospheric pressure (first reaction step).

Trimellitic acid: 5.9 parts by mass (0.03 mol; 18.0 mol % with respect to the total number of moles of polycarboxylic acid)

tert-butyl catechol (polymerization inhibitor): 0.1 parts by mass

Thereafter, the above materials were added, the pressure in the reaction vessel was lowered to 8.3 kPa, and the reaction was performed for 15 hours while maintaining the temperature at 200° C. After confirming that the softening point measured according to ASTM D36-86 reached a temperature of 120° C., the temperature was lowered to stop the reaction to obtain an amorphous resin 1 (second reaction step). The obtained amorphous resin 1 had a peak molecular weight Mp of 10000, a softening point Tm of 110° C., and a glass transition temperature Tg of 60° C.

<Production Example of Graft Polymer having Polyolefin as Trunk and Styrene Acrylic Polymer as Branch>

Low molecular weight polypropylene (Viscol 660P manufactured by Sanyo Chemical Industries, Ltd.): 10.0 parts by mass (0.02 mol; 2.4 mol % with respect to the total number of moles of the constituent monomers)

Xylene: 25.0 parts by mass

The above materials were charged into a reaction vessel to which a cooling pipe, a stirrer, a nitrogen introducing pipe, and a thermocouple were attached. Next, after the inside of the flask was replaced with nitrogen gas, the temperature was gradually raised to a temperature of 175° C. while stirring.

Styrene:

68.0 parts by mass (0.65 mol; 76.4 mol % with respect to the total number of moles of constituent monomers)

Cyclohexyl methacrylate:

5.0 parts by mass (0.03 mol; 3.5 mol % with respect to the total number of moles of constituent monomers)

Butyl acrylate:

12.0 parts by mass (0.09 mol; 11.0 mol % with respect to the total number of moles of constituent monomers)

Methacrylic acid:

5.0 parts by mass (0.06 mol; 6.8 mol % with respect to the total number of moles of constituent monomers)

Xylene: 10.0 parts by mass di-t-Butylperoxyhexahydroterephthalate: 0.5 parts by mass Thereafter, the above materials were dropped over 3 hours, and stirred for another 30 minutes. Subsequently, the solvent was removed to obtain a graft polymer having a polyolefin as a trunk and a styrene acrylic polymer as a branch. The obtained polymer had a peak molecular weight Mp of 6000, a softening point of 125° C., and a glass transition temperature Tg of 68° C.

<Production Example of Toner 1>

Amorphous resin 1 100 parts

Graft polymer having a polyolefin as a trunk and a styrene acrylic polymer as a branch 4 parts Fischer Tropsch wax (peak temperature of maximum endothermic peak of 90° C.) 4 parts Carbon black 10 parts The above materials were mixed using a Henschel mixer (type FM-75, manufactured by Mitsui Mining Co., Ltd.) at a rotation speed of 1500 rpm and a rotational time of 5 minutes, and then kneaded with a twin-screw kneader (PCM-30 type, manufactured by Ikegai Corp.) set to a temperature of 130° C. The obtained kneaded product was cooled and roughly pulverized to 1 mm or less with a hammer mill to obtain a roughly pulverized product. The obtained roughly pulverized product was finely pulverized using a mechanical pulverizer (T-250, manufactured by Turbo Kogyo Co., Ltd.) at a rotor rotation speed of 10000 rpm. Further, classification was performed using Faculty (F-300, manufactured by Hosokawa Micron Corporation) to obtain a toner particle 1. The operating conditions were set such that the classification rotor rotation speed was 6000 rpm and the dispersion rotor rotation speed was 7200 rpm.

Using the obtained toner particle 1, the heat treatment was performed by the surface treatment apparatus illustrated in FIGURE to obtain a heat-treated toner particle. The operating conditions were: feed amount=5 kg/hr, hot air temperature C=160° C., hot air flow rate=6 $m^3$/min, cold air temperature E=−5° C., cold air flow rate=4 $m^3$/min, blower flow rate=20 $m^3$/min, and injection air flow rate=1 $m^3$/min. The obtained heat-treated toner particles were equally divided into two groups, based on the number of particles, of the large particle diameter side and the small particle diameter side, using an inertial classification type Elbow jet (manufactured by Nittetsu Mining Co., Ltd.). The operating conditions were set to: feed amount=5 kg/hr; and adjusted to F classification edge (fine powder classification edge) set to 10 to 15 mm; and G classification edge (coarse powder classification edge) set to maximum and closed such that the heat-treated toner particles were equally divided into two groups of F particle (small particle diameter side toner particles) and M particles (large particle diameter side toner particle).

F particle 100 parts

Silica fine particle A: fumed silica surface-treated with hexamethyldisilazane (the median diameter on a number basis (D50) is 120 nm) 8 parts Small particle diameter inorganic fine particle: Titanium oxide fine particle surface-treated with isobutyltrimethoxysilane (the median diameter on a number basis (D50) is 10 nm) 1 part The above materials were mixed with a Henschel mixer (type FM-75, manufactured by Mitsui Miike Chemical Engineering Machinery, Co., Ltd.) at a rotation speed of 1900 rpm for a rotation time of 15 minutes to obtain an F toner (small particle diameter side toner).

M particle 100 parts

Silica fine particle A: fumed silica surface-treated with hexamethyldisilazane (the median diameter on a number basis (D50) is 120 nm) 4 parts Small particle diameter inorganic fine particle: Titanium oxide fine particle surface-treated with isobutyltrimethoxysilane (the median diameter on a number basis (D50) is 10 nm) 1 part The above materials were mixed with a Henschel mixer (type FM-75, manufactured by Mitsui Miike Chemical Engineering Machinery, Co., Ltd.) at a rotation speed of 1900 rpm for a rotation time of 5 minutes to obtain an M toner (large particle diameter side toner).

A toner 1 was obtained by homogeneously mixing the obtained F toner and M toner. The median diameter (D50) on a number basis of the toner 1 was 4.5 μm, the span value was 0.5, the average circularity was 0.968, the average coverage $S_s$ was 45 area %, the average coverage $S_1$ was 23 area %, the median adhesion index $I_s$ was 4.5 mN/m, and the median adhesion index $I_1$ was 8.0 mN/m. Further, the average coverage $B_s$ and the average coverage $B_1$ by the fixedly adhering-silica fine particle A were 85% and 45%, respectively. Material properties of the toner 1 are shown in Tables 3-1 and 3-2.

<Production Examples of Toners 2 to 37>

The same operation as in the production example of the toner 1 was carried out except that the presence or absence of use of the graft polymer having a polyolefin as a trunk and a styrene acrylic polymer as a branch, the operating condition of a mechanical pulverizer, the operating condition of Faculty F-300, and the surface treatment apparatus were changed as shown in Table 1, and the formulation/condition for external addition were changed as shown in Table 2-1, and Table 2-2 to obtain toners 2 to 37. Material properties of the toners 2 to 37 are shown in Tables 3-1 and 3-2.

Here, in Tables 2-1 and 2-2, the silica fine particles A are all silica fine particles surface-treated with hexamethyldisilazane. Further, the silica fine particle used as the small-diameter inorganic fine particle is a fumed silica surface-treated with hexamethyldisilazane, and the titanium oxide fine particle used as the large-diameter inorganic fine particle is titanium oxide surface-treated with isobutyltrimethoxysilane.

TABLE 1

| | | Producing method | | | |
|---|---|---|---|---|---|
| | | Operation | Operation condition of Faculty | | |
| Toner particle | Formulation Presence or absence of graft polymer | condition of mechanical pulverizer Rotor rotation speed [rpm] | Classification rotor rotation speed [rpm] | Dispersion rotor rotation speed [rpm] | Surface treatment device |
| 1 | present | 10000 | 6000 | 7200 | used |
| 2 | present | 10000 | 6000 | 7200 | used |

TABLE 1-continued

| | | Producing method | | | |
|---|---|---|---|---|---|
| | | Operation | Operation condition of Faculty | | |
| Toner particle | Formulation Presence or absence of graft polymer | condition of mechanical pulverizer Rotor rotation speed [rpm] | Classification rotor rotation speed [rpm] | Dispersion rotor rotation speed [rpm] | Surface treatment device |
| 3 | present | 10000 | 6000 | 7200 | used |
| 4 | present | 10000 | 6000 | 7200 | used |
| 5 | present | 10000 | 6000 | 7200 | used |
| 6 | absent | 10000 | 6000 | 7200 | used |
| 7 | absent | 10000 | 6000 | 7200 | not used |
| 8 | absent | 10000 | 8000 | 7200 | not used |
| 9 | absent | 10000 | 9500 | 7200 | not used |
| 10 | absent | 10000 | 9500 | 7200 | not used |
| 11 | absent | 10000 | 9500 | 7200 | not used |
| 12 | absent | 10000 | 9500 | 7200 | not used |
| 13 | absent | 10000 | 9500 | 7200 | not used |
| 14 | absent | 10000 | 9500 | 7200 | not used |
| 15 | absent | 10000 | 9500 | 7200 | not used |
| 16 | absent | 10000 | 9500 | 7200 | not used |
| 17 | absent | 10000 | 9500 | 7200 | not used |
| 18 | absent | 10000 | 9500 | 7200 | not used |
| 19 | absent | 10000 | 9500 | 7200 | not used |
| 20 | absent | 10000 | 9500 | 7200 | not used |
| 21 | absent | 10000 | 9500 | 7200 | not used |
| 22 | absent | 10000 | 9500 | 7200 | not used |
| 23 | absent | 10000 | 9500 | 7200 | not used |
| 24 | absent | 10000 | 9500 | 7200 | not used |
| 25 | absent | 10000 | 9500 | 7200 | not used |
| 26 | absent | 12000 | 9500 | 7200 | not used |
| 27 | absent | 9000 | 9500 | 7200 | not used |
| 28 | absent | 10000 | 11000 | 7200 | not used |
| 29 | absent | 10000 | 9500 | 7200 | not used |
| 30 | absent | 10000 | 9500 | 7200 | not used |
| 31 | absent | 10000 | 9500 | 7200 | not used |
| 32 | absent | 10000 | 9500 | 7200 | not used |
| 33 | absent | 10000 | 9500 | 7200 | not used |
| 34 | absent | 10000 | 9500 | 7200 | not used |
| 35 | absent | 10000 | 9500 | 7200 | not used |
| 36 | absent | 12300 | 9500 | 7200 | not used |
| 37 | absent | 8700 | 9500 | 7200 | not used |

TABLE 2-1

| | | Formulation/Condition of external adding for F toner (small particle diameter side toner) | | | | | | | | | |
|---|---|---|---|---|---|---|---|---|---|---|---|
| | | Small particle diameter inorganic fine particle | | | | Large particle diameter inorganic fine particle | | | | | |
| | | Titanium oxide fine particle | | Silica fine particle | | Titanium oxide fine particle | | Silica fine particle A | | | |
| Toner | Toner Particle | particle diameter [nm] | parts | particle diameter [nm] | parts | particle diameter [nm] | parts | type | particle diameter [nm] | parts | External addition time [min] |
| 1 | 1 | 10 | 1.0 | — | — | — | — | fumed | 120 | 8.0 | 15.0 |
| 2 | 2 | 10 | 1.0 | — | — | — | — | fumed | 120 | 8.0 | 15.0 |
| 3 | 3 | 10 | 1.0 | — | — | — | — | fumed | 120 | 8.0 | 15.0 |
| 4 | 4 | 10 | 1.0 | — | — | — | — | fumed | 120 | 8.0 | 9.0 |
| 5 | 5 | 10 | 1.0 | — | — | — | — | fumed | 120 | 8.0 | 10.0 |
| 6 | 6 | 10 | 1.0 | — | — | — | — | fumed | 120 | 8.0 | 10.0 |
| 7 | 7 | 10 | 1.0 | — | — | — | — | fumed | 120 | 8.0 | 10.0 |
| 8 | 8 | 10 | 1.0 | — | — | — | — | fumed | 120 | 8.0 | 10.0 |
| 9 | 9 | 10 | 1.0 | — | — | — | — | fumed | 120 | 8.0 | 10.0 |

TABLE 2-1-continued

| | | Formulation/Condition of external adding for F toner (small particle diameter side toner) | | | | | | | | | |
|---|---|---|---|---|---|---|---|---|---|---|---|
| | | Small particle diameter inorganic fine particle | | | | Large particle diameter inorganic fine particle | | | | | |
| | | Titanium oxide fine particle | | Silica fine particle | | Titanium oxide fine particle | | Silica fine particle A | | | |
| Toner | Toner Particle | particle diameter [nm] | parts | particle diameter [nm] | parts | particle diameter [nm] | parts | type | particle diameter [nm] | parts | External addition time [min] |
| 10 | 10 | 10 | 1.0 | — | — | — | — | sol-gel | 120 | 8.0 | 10.0 |
| 11 | 11 | 10 | 1.0 | — | — | — | — | sol-gel | 120 | 8.5 | 10.0 |
| 12 | 12 | 10 | 1.0 | — | — | — | — | sol-gel | 120 | 9.0 | 10.0 |
| 13 | 13 | 10 | 1.0 | — | — | — | — | sol-gel | 120 | 7.5 | 10.0 |
| 14 | 14 | 10 | 1.0 | — | — | — | — | sol-gel | 120 | 7.0 | 10.0 |
| 15 | 15 | 10 | 1.0 | — | — | — | — | sol-gel | 120 | 9.5 | 10.0 |
| 16 | 16 | 10 | 1.0 | — | — | — | — | sol-gel | 120 | 6.5 | 10.0 |
| 17 | 17 | 10 | 1.0 | — | — | — | — | sol-gel | 120 | 11.0 | 10.0 |
| 18 | 18 | 10 | 1.0 | — | — | — | — | sol-gel | 120 | 11.8 | 10.0 |
| 19 | 19 | 10 | 1.0 | 20 | 2.0 | — | — | sol-gel | 120 | 11.8 | 10.0 |
| 20 | 20 | 10 | 1.0 | — | — | — | — | sol-gel | 120 | 4.7 | 10.0 |
| 21 | 21 | 10 | 1.0 | — | — | — | — | sol-gel | 120 | 4.2 | 10.0 |
| 22 | 22 | 10 | 1.0 | — | — | — | — | sol-gel | 120 | 12.5 | 10.0 |
| 23 | 23 | 10 | 1.0 | — | — | — | — | sol-gel | 120 | 4.0 | 10.0 |
| 24 | 24 | 10 | 1.0 | — | — | — | — | sol-gel | 80 | 12.5 | 10.0 |
| 25 | 25 | 10 | 1.0 | — | — | — | — | sol-gel | 500 | 12.5 | 10.0 |
| 26 | 26 | 10 | 1.0 | — | — | — | — | sol-gel | 120 | 12.5 | 10.0 |
| 27 | 27 | 10 | 1.0 | — | — | — | — | sol-gel | 120 | 12.5 | 10.0 |
| 28 | 28 | 10 | 1.0 | — | — | — | — | sol-gel | 120 | 12.5 | 10.0 |
| 29 | 29 | 10 | 1.0 | — | — | 120 | 11.8 | — | — | — | (10.0) |
| 30 | 30 | 10 | 1.0 | — | — | — | — | sol-gel | 120 | 3.0 | 10.0 |
| 31 | 31 | 10 | 1.0 | — | — | — | — | sol-gel | 120 | 11.8 | 10.0 |
| 32 | 32 | 10 | 1.0 | — | — | — | — | sol-gel | 120 | 13.5 | 10.0 |
| 33 | 33 | 10 | 1.0 | — | — | — | — | sol-gel | 120 | 3.5 | 10.0 |
| 34 | 34 | 10 | 1.0 | — | — | — | — | sol-gel | 75 | 12.5 | 10.0 |
| 35 | 35 | 10 | 1.0 | — | — | — | — | sol-gel | 510 | 12.5 | 10.0 |
| 36 | 36 | 10 | 1.0 | — | — | — | — | sol-gel | 120 | 12.5 | 10.0 |
| 37 | 37 | 10 | 1.0 | — | — | — | — | sol-gel | 120 | 12.5 | 10.0 |

TABLE 2-2

| | | Formulation/Condition of external adding for M toner (large particle diameter side toner) | | | | | | | | | |
|---|---|---|---|---|---|---|---|---|---|---|---|
| | | Small particle diameter inorganic fine particle | | | | Large particle diameter inorganic fine particle | | | | | |
| | | Titanium oxide fine particle | | Silica fine particle | | Titanium oxide fine particle | | Silica fine particle A | | | |
| Toner | Toner Particle | particle diameter [nm] | parts | particle diameter [nm] | parts | particle diameter [nm] | parts | Producing method | particle diameter [nm] | parts | External addition time [min] |
| 1 | 1 | 10 | 1.0 | — | — | — | — | fumed | 120 | 4.0 | 5.0 |
| 2 | 2 | 10 | 1.0 | — | — | — | — | fumed | 120 | 4.0 | 3.0 |
| 3 | 3 | 10 | 1.0 | — | — | — | — | fumed | 120 | 4.0 | 6.0 |
| 4 | 4 | 10 | 1.0 | — | — | — | — | fumed | 120 | 4.0 | 5.0 |
| 5 | 5 | 10 | 1.0 | — | — | — | — | fumed | 120 | 4.0 | 10.0 |
| 6 | 6 | 10 | 1.0 | — | — | — | — | fumed | 120 | 4.0 | 10.0 |
| 7 | 7 | 10 | 1.0 | — | — | — | — | fumed | 120 | 4.0 | 10.0 |
| 8 | 8 | 10 | 1.0 | — | — | — | — | fumed | 120 | 4.0 | 10.0 |
| 9 | 9 | 10 | 1.0 | — | — | — | — | fumed | 120 | 4.0 | 10.0 |
| 10 | 10 | 10 | 1.0 | — | — | — | — | sol-gel | 120 | 4.0 | 10.0 |
| 11 | 11 | 10 | 1.0 | — | — | — | — | sol-gel | 120 | 3.5 | 10.0 |
| 12 | 12 | 10 | 1.0 | — | — | — | — | sol-gel | 120 | 3.0 | 10.0 |
| 13 | 13 | 10 | 1.0 | — | — | — | — | sol-gel | 120 | 4.5 | 10.0 |
| 14 | 14 | 10 | 1.0 | — | — | — | — | sol-gel | 120 | 5.0 | 10.0 |
| 15 | 15 | 10 | 1.0 | — | — | — | — | sol-gel | 120 | 2.5 | 10.0 |

TABLE 2-2-continued

| | | Formulation/Condition of external adding for M toner (large particle diameter side toner) | | | | | | | | | |
|---|---|---|---|---|---|---|---|---|---|---|---|
| | | Small particle diameter inorganic fine particle | | | | Large particle diameter inorganic fine particle | | | | | |
| | | Titanium oxide fine particle | | Silica fine particle | | Titanium oxide fine particle | | Silica fine particle A | | | |
| Toner | Toner Particle | particle diameter [nm] | parts | particle diameter [nm] | parts | particle diameter [nm] | parts | Producing method | particle diameter [nm] | parts | External addition time [min] |
| 16 | 16 | 10 | 1.0 | — | — | — | — | sol-gel | 120 | 5.5 | 10.0 |
| 17 | 17 | 10 | 1.0 | — | — | — | — | sol-gel | 120 | 3.0 | 10.0 |
| 18 | 18 | 10 | 1.0 | — | — | — | — | sol-gel | 120 | 3.2 | 10.0 |
| 19 | 19 | 10 | 1.0 | 20 | 2.0 | — | — | sol-gel | 120 | 3.2 | 10.0 |
| 20 | 20 | 10 | 1.0 | — | — | — | — | sol-gel | 120 | 3.3 | 10.0 |
| 21 | 21 | 10 | 1.0 | — | — | — | — | sol-gel | 120 | 3.0 | 10.0 |
| 22 | 22 | 10 | 1.0 | — | — | — | — | sol-gel | 120 | 3.2 | 10.0 |
| 23 | 23 | 10 | 1.0 | — | — | — | — | sol-gel | 120 | 3.0 | 10.0 |
| 24 | 24 | 10 | 1.0 | — | — | — | — | sol-gel | 80 | 3.2 | 10.0 |
| 25 | 25 | 10 | 1.0 | — | — | — | — | sol-gel | 500 | 3.2 | 10.0 |
| 26 | 26 | 10 | 1.0 | — | — | — | — | sol-gel | 120 | 3.2 | 10.0 |
| 27 | 27 | 10 | 1.0 | — | — | — | — | sol-gel | 120 | 3.2 | 10.0 |
| 28 | 28 | 10 | 1.0 | — | — | — | — | sol-gel | 120 | 3.2 | 10.0 |
| 29 | 29 | 10 | 1.0 | — | — | 120 | 3.2 | — | — | — | (10.0) |
| 30 | 30 | 10 | 1.0 | — | — | — | — | sol-gel | 120 | 3.0 | 10.0 |
| 31 | 31 | 10 | 1.0 | — | — | — | — | sol-gel | 120 | 11.8 | 10.0 |
| 32 | 32 | 10 | 1.0 | — | — | — | — | sol-gel | 120 | 3.5 | 10.0 |
| 33 | 33 | 10 | 1.0 | — | — | — | — | sol-gel | 120 | 2.5 | 10.0 |
| 34 | 34 | 10 | 1.0 | — | — | — | — | sol-gel | 75 | 3.2 | 10.0 |
| 35 | 35 | 10 | 1.0 | — | — | — | — | sol-gel | 510 | 3.2 | 10.0 |
| 36 | 36 | 10 | 1.0 | — | — | — | — | sol-gel | 120 | 3.2 | 10.0 |
| 37 | 37 | 10 | 1.0 | — | — | — | — | sol-gel | 120 | 3.2 | 10.0 |

TABLE 3-1

| Toner | Median diameter [μm] | Span value | Cirularity | Median diameter of Silica fine particle A [nm] | $S_s$ [area %] | $S_l$ [area %] | $S_l/S_s$ | $I_s$ [mN/m] | $I_l$ [mN/m] | $I_s/I_l$ |
|---|---|---|---|---|---|---|---|---|---|---|
| 1 | 4.5 | 0.5 | 0.968 | 120 | 45 | 23 | 0.51 | 4.5 | 8.0 | 0.56 |
| 2 | 4.5 | 0.5 | 0.968 | 120 | 45 | 25 | 0.56 | 4.5 | 7.7 | 0.58 |
| 3 | 4.5 | 0.5 | 0.968 | 120 | 45 | 22 | 0.49 | 4.5 | 8.0 | 0.56 |
| 4 | 4.5 | 0.5 | 0.968 | 120 | 49 | 23 | 0.47 | 3.7 | 8.0 | 0.46 |
| 5 | 4.5 | 0.5 | 0.968 | 120 | 48 | 20 | 0.42 | 3.8 | 8.5 | 0.45 |
| 6 | 4.5 | 0.5 | 0.968 | 120 | 48 | 20 | 0.42 | 3.9 | 8.7 | 0.45 |
| 7 | 4.5 | 0.5 | 0.955 | 120 | 48 | 20 | 0.42 | 4.0 | 8.9 | 0.45 |
| 8 | 4.5 | 0.7 | 0.955 | 120 | 48 | 20 | 0.42 | 4.0 | 8.9 | 0.45 |
| 9 | 4.5 | 0.8 | 0.955 | 120 | 48 | 20 | 0.42 | 4.1 | 9.1 | 0.45 |
| 10 | 4.5 | 0.8 | 0.955 | 120 | 48 | 20 | 0.42 | 4.3 | 9.4 | 0.46 |
| 11 | 4.5 | 0.8 | 0.955 | 120 | 50 | 18 | 0.36 | 3.5 | 10.4 | 0.34 |
| 12 | 4.5 | 0.8 | 0.955 | 120 | 52 | 17 | 0.33 | 3.2 | 11.0 | 0.29 |
| 13 | 4.5 | 0.8 | 0.955 | 120 | 46 | 22 | 0.48 | 5.1 | 9.3 | 0.55 |
| 14 | 4.5 | 0.8 | 0.955 | 120 | 44 | 24 | 0.55 | 5.9 | 9.1 | 0.65 |
| 15 | 4.5 | 0.8 | 0.955 | 120 | 54 | 16 | 0.30 | 2.9 | 11.5 | 0.25 |
| 16 | 4.5 | 0.8 | 0.955 | 120 | 42 | 26 | 0.62 | 6.3 | 8.9 | 0.71 |
| 17 | 4.5 | 0.8 | 0.955 | 120 | 58 | 18 | 0.31 | 2.5 | 11.0 | 0.23 |
| 18 | 4.5 | 0.8 | 0.955 | 120 | 61 | 19 | 0.31 | 2.4 | 11.2 | 0.21 |
| 19 | 4.5 | 0.8 | 0.955 | 120 | 61 | 19 | 0.31 | 2.4 | 11.2 | 0.21 |
| 20 | 4.5 | 0.8 | 0.955 | 120 | 30 | 20 | 0.67 | 8.0 | 10.1 | 0.79 |
| 21 | 4.5 | 0.8 | 0.955 | 120 | 26 | 17 | 0.65 | 8.2 | 10.3 | 0.80 |
| 22 | 4.5 | 0.8 | 0.955 | 120 | 65 | 18 | 0.28 | 2.4 | 11.2 | 0.21 |
| 23 | 4.5 | 0.8 | 0.955 | 120 | 24 | 17 | 0.71 | 8.2 | 10.3 | 0.80 |
| 24 | 4.5 | 0.8 | 0.955 | 80 | 59 | 17 | 0.29 | 6.1 | 20.8 | 0.29 |
| 25 | 4.5 | 0.8 | 0.955 | 500 | 55 | 15 | 0.27 | 6.1 | 21.2 | 0.29 |
| 26 | 3.1 | 0.8 | 0.955 | 120 | 55 | 15 | 0.27 | 6.1 | 21.3 | 0.29 |
| 27 | 5.9 | 0.8 | 0.955 | 120 | 67 | 19 | 0.28 | 2.5 | 11.2 | 0.22 |
| 28 | 4.5 | 0.9 | 0.955 | 120 | 55 | 15 | 0.27 | 6.1 | 21.3 | 0.29 |
| 29 | 4.5 | 0.8 | 0.955 | — | 0 | 0 | — | 11.2 | 29.3 | 0.38 |

TABLE 3-1-continued

| Toner | Median diameter [μm] | Span value | Cirularity | Median diameter of Silica fine particle A [nm] | $S_s$ [area %] | $S_l$ [area %] | $S_l/S_s$ | $I_s$ [mN/m] | $I_l$ [mN/m] | $I_s/I_l$ |
|---|---|---|---|---|---|---|---|---|---|---|
| 30 | 4.5 | 0.8 | 0.955 | 120 | 17 | 17 | 1.00 | 10.1 | 10.3 | 0.98 |
| 31 | 4.5 | 0.8 | 0.955 | 120 | 61 | 59 | 0.97 | 2.0 | 2.1 | 0.95 |
| 32 | 4.5 | 0.8 | 0.955 | 120 | 71 | 20 | 0.28 | 2.0 | 9.5 | 0.21 |
| 33 | 4.5 | 0.8 | 0.955 | 120 | 19 | 14 | 0.74 | 8.7 | 10.7 | 0.81 |
| 34 | 4.5 | 0.8 | 0.955 | 75 | 50 | 14 | 0.28 | 6.2 | 21.2 | 0.29 |
| 35 | 4.5 | 0.8 | 0.955 | 510 | 54 | 14 | 0.26 | 6.2 | 21.4 | 0.29 |
| 36 | 2.9 | 0.8 | 0.955 | 120 | 54 | 14 | 0.26 | 6.1 | 21.3 | 0.29 |
| 37 | 6.1 | 0.8 | 0.955 | 120 | 69 | 20 | 0.29 | 2.5 | 11.2 | 0.22 |

TABLE 3-2

| Toner | $S_s$ [area %] | $S_l$ [area %] | $B_s$ [area %] | $B_l$ [area %] | $(S_s - B_s) + (S_l - B_l)$ |
|---|---|---|---|---|---|
| 1 | 45 | 23 | 38 | 11 | 19 |
| 2 | 45 | 25 | 38 | 10 | 22 |
| 3 | 45 | 23 | 38 | 12 | 18 |
| 4 | 45 | 23 | 29 | 10 | 29 |
| 5 | 48 | 20 | 26 | 14 | 28 |
| 6 | 48 | 20 | 26 | 14 | 28 |
| 7 | 48 | 20 | 26 | 14 | 28 |
| 8 | 48 | 20 | 26 | 14 | 28 |
| 9 | 48 | 20 | 26 | 14 | 28 |
| 10 | 48 | 20 | 24 | 13 | 31 |
| 11 | 50 | 18 | 23 | 13 | 32 |
| 12 | 52 | 17 | 21 | 12 | 36 |
| 13 | 46 | 22 | 25 | 13 | 30 |
| 14 | 44 | 24 | 24 | 14 | 30 |
| 15 | 54 | 16 | 22 | 11 | 37 |
| 16 | 42 | 26 | 25 | 16 | 27 |
| 17 | 58 | 18 | 23 | 13 | 40 |
| 18 | 61 | 19 | 24 | 13 | 43 |
| 19 | 61 | 19 | 21 | 12 | 47 |
| 20 | 30 | 20 | 20 | 14 | 16 |
| 21 | 26 | 17 | 17 | 12 | 14 |
| 22 | 65 | 18 | 23 | 13 | 47 |
| 23 | 24 | 17 | 16 | 12 | 13 |
| 24 | 59 | 17 | 21 | 12 | 43 |
| 25 | 55 | 15 | 17 | 10 | 43 |
| 26 | 55 | 15 | 19 | 11 | 40 |
| 27 | 67 | 19 | 23 | 13 | 50 |
| 28 | 55 | 15 | 19 | 11 | 40 |
| 29 | 0 | 0 | — | — | — |
| 30 | 17 | 17 | 14 | 14 | 6 |
| 31 | 61 | 59 | 24 | 21 | 75 |
| 32 | 71 | 20 | 25 | 14 | 52 |
| 33 | 19 | 14 | 13 | 11 | 9 |
| 34 | 50 | 14 | 20 | 11 | 33 |
| 35 | 54 | 14 | 22 | 11 | 35 |
| 36 | 54 | 14 | 22 | 11 | 35 |
| 37 | 69 | 20 | 24 | 14 | 51 |

<Production Example of Magnetic Core Particle 1>

Step 1 (Weighing and Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

The ferrite raw materials were weighed such that the above materials had the composition ratio. Thereafter, the mixture was pulverized and mixed for 5 hours in a dry vibration mill using stainless steel beads with a diameter of ⅛ inches.

Step 2 (Temporary Firing Step):

The obtained pulverized product was formed into pellets of about 1 mm square using a roller compactor. After removing coarse powder from this pellet with a vibrating sieve with 3 mm openings and then removing fine powder with a vibrating sieve with 0.5 mm openings, using a burner type firing furnace, under a nitrogen atmosphere (oxygen concentration of 0.01 vol %), the resultant was fired at a temperature of 1000° C. for 4 hours to prepare a temporarily fired ferrite. The composition of the obtained temporarily fired ferrite is as follows.

$$(MnO)_a(MgO)_b(SrO)_c(Fe_2O_3)_d.$$

In the above Formula, a is 0.257, b is 0.117, c is 0.007, and d is 0.393.

Step 3 (Pulverization Step):

The obtained temporarily fired ferrite was crushed to about 0.3 mm with a crusher, and pulverized in a wet ball mill for 1 hour using zirconia beads with a diameter of ⅛ inches and with 30 parts of water added therein based on 100 parts of the temporarily fired ferrite. The obtained slurry was pulverized for 4 hours in a wet ball mill using alumina beads with a diameter of 1/16 inches to obtain a ferrite slurry (finely pulverized product of temporarily fired ferrite).

Step 4 (Granulation Step):

Into the ferrite slurry, 1.0 part of ammonium polycarboxylate as a dispersant and 2.0 parts of polyvinyl alcohol as a binder were added based on 100 parts of temporarily fired ferrite, and the mixture was granulated into spherical particle with a spray dryer (manufacturer: Ohkawara Kakohki Co., Ltd.). The obtained particle was adjusted in particle size, and then heated at 650° C. for 2 hours using a rotary kiln to remove the organic components of the dispersant and the binder.

Step 5 (Firing Step):

In order to control the firing atmosphere, the temperature was raised from room temperature to 1300° C. over 2 hours under a nitrogen atmosphere (oxygen concentration of 1.00 vol %) in an electric furnace, and then firing was performed for 4 hours at 1150° C. Thereafter, the temperature was lowered to 60° C. over 4 hours, the nitrogen atmosphere was replaced with air, and the product was taken out at 40° C. or less.

Step 6 (Selection Step):

After crushing the aggregated particle, the low magnetic force product was cut by magnetic separation, and coarse particle was removed by sieving with a sieve with 250 μm openings to obtain a magnetic core particle 1 having a 50% particle diameter (D50) of 37.0 μm based on the volume distribution.

<Preparation of Coating Resin 1>

| | |
|---|---|
| Cyclohexyl methacrylate | 26.8 parts |
| Methyl methacrylate | 0.2 parts |
| Methyl methacrylate macromonomer | 8.4 parts |

(macromonomer with a weight average molecular weight of 5000 having a methacryloyl group at one end)

| | |
|---|---|
| Toluene | 31.3 parts |
| Methyl ethyl ketone | 31.3 parts |

The above material was placed in a four-neck separable flask equipped with a reflux condenser, a thermometer, a nitrogen introducing pipe, and a stirring apparatus, and nitrogen gas was introduced to make a sufficient nitrogen atmosphere. Thereafter, the temperature was raised to 80° C., 2.0 parts of azobisisobutyronitrile was added, and the mixture was refluxed for 5 hours for polymerization. Hexane was injected into the obtained reaction product to precipitate a copolymer, and the precipitate was separated by filtration and then vacuum-dried to obtain a coating resin 1.

Subsequently, 30 parts of the coating resin 1 was dissolved in 40 parts of toluene and 30 parts of methyl ethyl ketone to obtain a polymer solution 1 (solid content of 30 mass %).

<Preparation of Coating Resin Solution 1>

| | |
|---|---|
| Polymer solution 1 (resin solid content concentration of 30%) | 33.3 mass % |
| Toluene | 66.4 mass % |
| Carbon black Regal 330 (made by Cabot Corporation) | 0.3 mass % |

(primary particle diameter of 25 nm, nitrogen adsorption specific surface area of 94 $m^2/g$, DBP oil absorption of 75 mL/100 g)

The above materials were mixed, and dispersion was performed for 1 hour with a paint shaker using zirconia beads of 0.5 mm in diameter. The obtained dispersion was filtered with a 5.0 μm membrane filter to obtain a coating resin solution 1.

<Production Example of Magnetic Carrier 1>

(Resin Coating Step)

The magnetic core particle 1 and the coating resin solution 1 were charged into a vacuum degassing type kneader maintained at normal temperature (the amount of the coating resin solution to be charged is 2.5 parts as a resin component based on 100 parts of the magnetic core particle 1). After the charging, the mixture was stirred at a rotation speed of 30 rpm for 15 minutes, and after the solvent volatilized a certain amount or more (80 mass %), heated to 80° C. while mixing under reduced pressure to distill off toluene over 2 hours, and then cooled. From the obtained magnetic carrier, low magnetic force product was separated by magnetic separation, passed through a sieve with an opening of 70 μm, and then classified with an air classifier to obtain a magnetic carrier 1 having a 50% particle diameter (D50) of 38.2 μm based on the volume distribution.

<Production Example of Two-Component Developer 1>

92.0 parts of the magnetic carrier 1 and 8.0 parts of the toner 1 were mixed by a V-type mixer (V-20, manufactured by Seishin Enterprise Co., Ltd.) to obtain a two-component developer 1.

<Production Examples of Two-Component Developers 2 to 37>

The same operation was performed except that the toner 1 was changed to toners 2 to 37 in the production example of the two-component developer 1 to obtain two-component developers 2 to 37.

Example 1

The following evaluation was performed using the above-described two-component developer 1.

The two-component developer 1 was placed in a developing apparatus at a black position, using a modified machine of imageRUNNER ADVANCE C5560 (manufactured by Canon Inc.) as an image forming apparatus. The apparatus was modified such that fixing temperature, process speed, DC voltage $V_{DC}$ of developer carrier, charging voltage $V_D$ of electrostatic latent image carrier, and laser power can be freely set. In the image output evaluation, an FFh image (solid image) having a desired image ratio was output, and $V_{DC}$, $V_D$, and the laser power was adjusted such that a desired amount of toner was applied to the FFh image, and evaluations described later were performed. FFh is a value representing 256 gradations in hexadecimal, 00h being the first gradation (white background) of 256 gradations, and FFh being the 256th gradation (solid part) of 256 gradations.

After performing the endurance test below, the two-component developers were evaluated based on the following evaluation methods. The evaluation results are shown in Table 4.

[Endurance Test]

Paper: GFC-081 (81.0 $g/m^2$)

(Canon Marketing Japan Inc.)

Evaluation image: 00h image

Test environment: high temperature and high humidity environment (temperature of 30° C./humidity of 80% RH (hereinafter H/H))

Fixing temperature: 160° C.

Process speed: 377 mm/sec

The endurance test was conducted by outputting the above evaluation images for 600,000 sheets.

[Fogging]

Paper: CS-680 (68.0 $g/m^2$)

(Canon Marketing Japan Inc.)

Evaluation image: 00h image on the entire surface

Vback: 150 V (adjusted with DC voltage $V_{DC}$ of developer carrier, charging voltage $V_D$ of electrostatic latent image carrier, and laser power)

Test environment: high temperature and high humidity environment (temperature of 30° C./humidity of 80% RH (hereinafter H/H))

Fixing temperature: 170° C.

Process speed: 377 mm/sec

The average reflectance Ds (%) of the evaluation paper before sheet passing is measured using a reflectometer (REFLECTOMETER MODEL TC-6DS: manufactured by Tokyo Denshoku Co., Ltd.). Next, the average reflectance Dr (%) of the evaluation paper after sheet passing is measured. Then, the value of fogging was calculated using the following Expression. The obtained fogging value was evaluated according to the following evaluation criteria.

$$\text{Fogging (\%)} = \text{Dr (\%)} - \text{Ds (\%)}$$

(Evaluation Criteria)

A: Fogging of less than 0.3% (Really Excellent)

B: Fogging of 0.3% or more and less than 0.5% (Excellent)

C: Fogging of 0.5% or more and less than 0.8% (Good)

D: Fogging of 0.8% or more and less than 1.2% (No Problem)

E: Fogging of 1.2% or more (Unacceptable)

[Developability]

Paper: GFC-081 (81.0 g/m$^2$)

(Canon Marketing Japan Inc.)

Vcontrast: 350 V (adjusted with DC voltage $V_{DC}$ of developer carrier, charging voltage $V_D$ of electrostatic latent image carrier, and laser power)

Evaluation image: an FFh image of 2 cm×5 cm is placed at the center of the paper Test environment: normal temperature and normal humidity environment (temperature of 23° C./humidity of 50% RH (hereinafter N/N))

Fixing temperature: 170° C.

Process speed: 377 mm/sec

The image density at the center is measured using an X-Rite color reflection densitometer (500 series: manufactured by X-Rite Inc.). The obtained image density was evaluated according to the following evaluation criteria.

(Evaluation Criteria)

A: The image density value is 1.35 or more (Really Excellent)

B: The image density value is 1.30 or more and less than 1.35 (Excellent)

C: The image density value is 1.25 or more and less than 1.30 (Good)

D: The image density value is 1.20 or more and less than 1.25 (No Problem)

E: The image density value is less than 1.20 (Unacceptable)

[Low-Temperature Fixability]

Paper: GFC-081 (81.0 g/m$^2$)

(Canon Marketing Japan Inc.)

The amount of toner applied onto paper: 0.30 mg/cm$^2$ (adjusted with DC voltage $V_{DC}$ of developer carrier, charging voltage $V_D$ of electrostatic latent image carrier, and laser power)

Evaluation image: an image of 2 cm×5 cm is placed at the center of the above A4 sheet Test environment: low temperature and low humidity environment (temperature of 15° C./humidity of 10% RH (hereinafter L/L))

Fixing temperature: 150° C.

Process speed: 377 mm/sec

The image density at the center is measured at first using an X-Rite color reflection densitometer (500 series: manufactured by X-Rite Inc.). Next, for the portion where the image density has been measured, the fixed image was rubbed (five reciprocations) with silbon paper under a load of 4.9 kPa (50 g/cm$^2$), and the image density is measured again. Then, the reduction rate of the image density before and after rubbing was calculated using the following Expression. The obtained image density reduction rate was evaluated according to the following evaluation criteria.

Image density reduction rate (%)=(Image density before rubbing−Image density after rubbing)/Image density before rubbing×100

(Evaluation Criteria)

A: Image density reduction rate of less than 5.0% (Really Excellent)

B: Image density reduction rate of 5.0% or more and less than 8.0% (Excellent)

C: Image density reduction rate of 8.0% or more and less than 10.0% (Good)

D: Image density reduction rate of 10.0% or more and less than 13.0% (No Problem)

E: Image density reduction rate of 13.0% or more (Unacceptable)

[Image Quality]

Paper: GFC-081 (81.0 g/m$^2$)

(Canon Marketing Japan Inc.)

Vcontrast: 300 V (adjusted with DC voltage Vic of developer carrier, charging voltage VD of electrostatic latent image carrier, and laser power)

Evaluation image: a vertical line image of 1 dot and 1 space is placed.

Test environment: normal temperature and normal humidity environment (temperature of 23° C./humidity of 50% RH (hereinafter N/N))

Fixing temperature: 170° C.

Process speed: 377 mm/sec

Personal IAS (image analysis system) (manufactured by QEA Inc.) was used to measure the value of Blur (a value representing the blur of a line defined by ISO 13660). The obtained Blur value was evaluated according to the following evaluation criteria.

(Evaluation Criteria)

A: Blur value of less than 35 μm (Really Excellent)

B: Blur value of 35 μm or more and less than 38 μm (Excellent)

C: Blur value of 38 μm or more and less than 41 μm (Good)

D: Blur value of 41 μm or more and less than 44 μm (No Problem)

E: Blur value of 44 μm or more (Unacceptable)

[Toner Fluidity]

The fluidity of the toner was evaluated using aggregation degree using the following criteria. As a measuring apparatus, a "powder tester" (manufactured by Hosokawa Micron Corporation) was used, and a sieve with 38 μm openings (400 mesh), a sieve with 75 μm openings (200 mesh), and a sieve with 150 μm openings (100 mesh) were sequentially stacked from the bottom on a vibrating table of the powder tester. The measurement was performed as follows in an environment of a temperature of 23° C. and a relative humidity of 60%.

(1) The vibration width of the vibrating table was adjusted to 0.5 mm.

(2) Five grams of the toner which had been allowed to stand for 24 hours in advance in an environment of a temperature of 23° C. and a relative humidity of 60% were precisely weighed, and gently placed at the top of the sieve with 150 μm openings.

(3) The sieve was vibrated for 30 seconds, and then the mass of the toner remaining on each sieve was measured to calculate the aggregation degree based on the following Expression.

Aggregation degree (%)={(sample mass (g) on sieve with 150 μm openings)/5 (g)}×100+{(sample mass (g) on sieve with 75 μm openings)/5 (g)}×100×0.6+{(sample mass (g) on sieve with 38 μm openings)/5 (g)}×100×0.2

(Evaluation Criteria)

A: Aggregation degree of less than 20% (Really Excellent)

B: Aggregation degree of 20% or more and less than 30% (Excellent)

C: Aggregation degree of 30% or more and less than 35% (Good)

D: Aggregation degree of 35% or more and less than 45% (No Problem)

E: Aggregation degree of 45% or more (Unacceptable)

[Contamination]

First, with an image evaluation machine, a solid image of 80 h was output over the entire surface of A3 paper under low temperature and low humidity (L/L) environment, and the average image density ds of 9 points on determined positions (3 points on the upper end side, 3 points on the lower end side, 3 points at the middle position) of the output image was determined. Further, the DC voltage $V_{DC}$ of the developer carrier, the charging voltage $V_D$ of the electrostatic latent image carrier, the laser power, and the transfer current were checked and recorded.

Next, the endurance test in which 1000 sheets of a solid image (FFh print ratio of 50% horizontal band) under high temperature and high humidity (H/H) environment was output was performed using an endurance evaluation machine.

After performing the above endurance test, the charge roller was transferred to the image evaluation machine, and an images was output under L/L environment, the DC voltage $V_{DC}$ of the developer carrier, the charging voltage $V_D$ of the electrostatic latent image carrier, the laser power and the transfer current were set to the same as in the image output conditions before the endurance test. With respect to the obtained image, an average image density de of 9 points at the above-described positions was determined.

The density difference was determined from the following Expression using the obtained de and ds, and evaluation was made according to the following criteria.

$$\text{Density difference}=|ds-de|$$

<Evaluation Criteria>

A: The density difference is less than 0.10 (Really Excellent)

B: The density difference is 0.10 or more and less than 0.15 (Excellent)

C: The density difference is 0.15 or more and less than 0.25 (Good)

D: The density difference is 0.25 or more and less than 0.30 (No Problem)

E: The density difference is 0.30 or more (Unacceptable)

Examples 2 to 28 and Comparative Examples 1 to 9

The evaluation was performed in the same manner as in Example 1 except that the two-component developers 2 to 37 were used. The evaluation results are shown in Table 4. The cases using the two-component developers 2 to 28 correspond to Examples 2 to 28 and the cases using the two-component developers 29 to 37 correspond to Comparative Examples 1 to 9.

TABLE 4

| Evaluation results | | | | | | | | | | | | | | |
|---|---|---|---|---|---|---|---|---|---|---|---|---|---|---|
| | Low-temperature fixability [%] | | | | | | | | | | | | | |
| Example / Comparative Example | | Image density before friction | Image density after friction | Reduction rate | Fogging property [%] | | Developability [—] | | Image quality [μm] | | Fluidity [—] | | Contamination [—] | |
| | | | | | Fogging | | Density | | Blur | | Aggregation degree | | Density change | |
| 1 | A | 1.35 | 1.35 | 0% | A | 0.1% | A | 1.41 | A | 31 μm | C | 32 | A | 0.09 |
| 2 | A | 1.35 | 1.35 | 0% | A | 0.1% | A | 1.42 | A | 31 μm | B | 25 | B | 0.11 |
| 3 | A | 1.35 | 1.35 | 0% | A | 0.1% | A | 1.41 | A | 31 μm | C | 33 | A | 0.07 |
| 4 | A | 1.35 | 1.35 | 0% | A | 0.1% | A | 1.39 | A | 31 μm | A | 14 | B | 0.13 |
| 5 | A | 1.35 | 1.35 | 0% | A | 0.0% | A | 1.38 | A | 31 μm | A | 18 | B | 0.13 |
| 6 | A | 1.35 | 1.35 | 0% | A | 0.1% | A | 1.36 | A | 31 μm | A | 18 | B | 0.12 |
| 7 | A | 1.35 | 1.35 | 0% | A | 0.2% | A | 1.35 | A | 31 μm | A | 18 | B | 0.13 |
| 8 | A | 1.35 | 1.35 | 0% | B | 0.3% | B | 1.33 | A | 34 μm | A | 17 | B | 0.12 |
| 9 | A | 1.35 | 1.35 | 0% | B | 0.4% | B | 1.31 | B | 35 μm | A | 15 | B | 0.13 |
| 10 | A | 1.35 | 1.35 | 0% | C | 0.5% | C | 1.29 | B | 35 μm | A | 13 | B | 0.14 |
| 11 | A | 1.35 | 1.35 | 0% | B | 0.4% | B | 1.30 | B | 37 μm | A | 15 | B | 0.15 |
| 12 | A | 1.35 | 1.35 | 0% | B | 0.3% | B | 1.31 | C | 38 μm | A | 12 | C | 0.25 |
| 13 | A | 1.35 | 1.35 | 0% | C | 0.6% | C | 1.26 | B | 35 μm | A | 16 | B | 0.14 |
| 14 | A | 1.35 | 1.35 | 0% | C | 0.7% | C | 1.25 | B | 35 μm | A | 13 | B | 0.13 |
| 15 | A | 1.35 | 1.35 | 0% | B | 0.3% | B | 1.33 | C | 39 μm | A | 14 | C | 0.25 |

TABLE 4-continued

| Evaluation results | | | | | | | | | | | | | | |
|---|---|---|---|---|---|---|---|---|---|---|---|---|---|---|
| | Low-temperature fixability [%] | | | | | | | | | | | | | |
| Example / Comparative Example | | Image density before friction | Image density after friction | Reduction rate | | Fogging property [%] Fogging | | Developability [—] Density | | Image quality [μm] Blur | | Fluidity [—] Aggregation degree | | Contamination [—] Density change |
| 16 | A | 1.35 | 1.35 | 0% | D | 0.8% | D | 1.23 | B | 35 μm | A | 19 | B | 0.12 |
| 17 | A | 1.35 | 1.29 | 4% | B | 0.3% | B | 1.32 | C | 39 μm | A | 13 | D | 0.26 |
| 18 | B | 1.35 | 1.25 | 7% | B | 0.3% | B | 1.32 | C | 40 μm | A | 14 | D | 0.27 |
| 19 | B | 1.35 | 1.25 | 7% | B | 0.3% | B | 1.30 | C | 40 μm | A | 12 | D | 0.28 |
| 20 | A | 1.35 | 1.35 | 0% | D | 0.9% | D | 1.21 | B | 35 μm | C | 35 | A | 0.07 |
| 21 | A | 1.35 | 1.35 | 0% | D | 1.0% | D | 1.20 | B | 35 μm | D | 39 | A | 0.06 |
| 22 | C | 1.35 | 1.23 | 9% | B | 0.3% | B | 1.32 | C | 40 μm | A | 13 | D | 0.29 |
| 23 | A | 1.35 | 1.35 | 0% | D | 1.1% | D | 1.20 | B | 35 μm | D | 42 | A | 0.06 |
| 24 | D | 1.35 | 1.19 | 12% | C | 0.5% | C | 1.26 | C | 40 μm | A | 14 | D | 0.28 |
| 25 | C | 1.35 | 1.24 | 8% | C | 0.5% | C | 1.26 | C | 40 μm | A | 12 | D | 0.28 |
| 26 | C | 1.35 | 1.24 | 8% | C | 0.5% | C | 1.25 | C | 39 μm | A | 15 | D | 0.26 |
| 27 | D | 1.35 | 1.19 | 12% | B | 0.3% | B | 1.32 | D | 43 μm | A | 14 | D | 0.29 |
| 28 | D | 1.35 | 1.23 | 9% | D | 1.1% | D | 1.20 | C | 40 μm | A | 13 | D | 0.27 |
| 1 | B | 1.35 | 1.25 | 7% | E | 1.4% | E | 1.12 | C | 40 μm | E | 46 | E | 0.35 |
| 2 | A | 1.35 | 1.35 | 0% | E | 1.2% | E | 1.16 | B | 35 μm | E | 47 | A | 0.04 |
| 3 | E | 1.35 | 1.14 | 16% | B | 0.3% | B | 1.31 | D | 42 μm | A | 10 | E | 0.45 |
| 4 | E | 1.35 | 1.16 | 14% | B | 0.3% | B | 1.32 | C | 40 μm | A | 12 | E | 0.40 |
| 5 | A | 1.35 | 1.35 | 0% | E | 1.3% | E | 1.14 | B | 35 μm | E | 46 | A | 0.06 |
| 6 | E | 1.35 | 1.15 | 15% | D | 0.9% | D | 1.20 | C | 40 μm | A | 18 | B | 0.15 |
| 7 | C | 1.35 | 1.24 | 8% | E | 1.2% | E | 1.16 | C | 40 μm | A | 17 | C | 0.16 |
| 8 | C | 1.35 | 1.24 | 8% | E | 1.2% | E | 1.14 | C | 39 μm | A | 17 | C | 0.16 |
| 9 | E | 1.35 | 1.18 | 13% | B | 0.3% | B | 1.32 | E | 45 μm | A | 15 | E | 0.40 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-081290, filed Apr. 22, 2019, and Japanese Patent Application No. 2019-128589, filed Jul. 10, 2019, which are hereby incorporated by reference herein in their entirety.

What is claimed is:

1. A toner, comprising:

a toner particle containing a binder resin; and a silica fine particle A on a surface of the toner particle, said silica fine particle A having a median diameter on a number basis of 80 to 500 nm by observing the toner with a scanning electron microscope, wherein a median diameter (D50) on a number basis of the toner is 3.0 to 6.0 μm, when the toner is divided into a first group including a smaller size of the toner particle, and a second group including a larger size of the toner particle, $S_1/S_s \leq 0.80$ and $S_s$ is 20 to 70 area %, where $S_s$ is an average coverage with the silica fine particle A determined by image analysis of the first group with a scanning electron microscope and $S_1$ is an average coverage with the silica fine particle A determined by image analysis of the second group with a scanning electron microscope, and $25 \leq B_s$ and $20 \leq (S_s - B_s) + (S_1 - B_1) \leq 35$ where $B_s$ (area %) is an average coverage with the silica fine particle A fixedly adhering to a surface of the toner particle in the first group and $B_1$ (area %) is an average coverage with the silica fine particle A fixedly adhering to a surface of the toner particle in the second group.

2. The toner according to claim 1, wherein $0.30 \leq S_1/S_s \leq 0.70$.

3. The toner according to claim 1, wherein the toner contains 4.0 to 7.0 parts by mass of silica fine particle A based on 100 parts by mass of the toner particle.

4. The toner according to claim 1, wherein the silica fine particle A is fumed silica.

5. The toner according to claim 1, having a span value of 0.2 to 0.7, where the span value is (D90−D10)/D50, when D90 is a cumulative 90% particle diameter on a number basis of the toner and D10 is a cumulative 10% particle diameter on a number basis of the toner.

* * * * *